US011406240B1

(12) United States Patent
Davila et al.

(10) Patent No.: US 11,406,240 B1
(45) Date of Patent: Aug. 9, 2022

(54) FLOOR CLEANER

(71) Applicant: Techtronic Floor Care Technology Limited, Tortola (VG)

(72) Inventors: Rafael Davila, Kannapolis, NC (US); Michael Paul Dawson, Huntersville, NC (US); Don Lydic, Mooresville, NC (US); Robert McRorie, Huntersville, NC (US); Benjamin Shrader, Newton, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 0 days.

(21) Appl. No.: 17/713,875

(22) Filed: Apr. 5, 2022

Related U.S. Application Data

(63) Continuation of application No. 16/551,485, filed on Aug. 26, 2019, now Pat. No. 11,291,345.

(60) Provisional application No. 62/723,345, filed on Aug. 27, 2018.

(51) Int. Cl.
*A47L 11/40* (2006.01)
*A47L 9/04* (2006.01)

(52) U.S. Cl.
CPC ..... *A47L 11/4044* (2013.01); *A47L 9/0477* (2013.01); *A47L 11/4041* (2013.01); *A47L 11/4083* (2013.01)

(58) Field of Classification Search
CPC ..... A47L 11/4044; A47L 9/0477; A47L 11/4041; A47L 11/4083
See application file for complete search history.

(56) References Cited

U.S. PATENT DOCUMENTS

| | | | |
|---|---|---|---|
| 1,649,937 | A | 11/1927 | Waltz |
| 1,915,072 | A | 6/1933 | Richter et al. |
| 2,121,880 | A | 6/1938 | Miller |
| 2,216,709 | A | 10/1940 | Langille |

(Continued)

FOREIGN PATENT DOCUMENTS

| | | | |
|---|---|---|---|
| CN | 1138500 | C | 2/2004 |
| CN | 1303930 | C | 3/2007 |

(Continued)

OTHER PUBLICATIONS

International Searching Authority Invitation to Pay Additional Fees for Application No. PCT/US2019/048178 dated Nov. 9, 2019 (11 pages).

(Continued)

*Primary Examiner* — David Redding
(74) *Attorney, Agent, or Firm* — Michael Best & Friedrich LLP

(57) ABSTRACT

A floor cleaner including a vacuum source, a supply tank configured to store a cleaning fluid, and a distribution nozzle in fluid communication with the supply tank. The distribution nozzle is configured to dispense the cleaning fluid onto a surface to be cleaned. The floor cleaner further includes a base movable over a surface to be cleaned, the base includes a suction inlet in fluid communication with the vacuum source, a brushroll chamber, a brushroll in the brushroll chamber, the brushroll rotatable about a brushroll axis. The base further includes a brushroll cover releasably attached to the base, the brushroll cover removable to access the brushroll chamber and the brushroll, the brushroll cover having a squeegee that contacts the brushroll. The brushroll axis is between a lower end of the base and the squeegee.

30 Claims, 24 Drawing Sheets

(56) References Cited

U.S. PATENT DOCUMENTS

| | | | |
|---|---|---|---|
| 2,648,868 | A | 8/1953 | Humphrey |
| 2,740,984 | A | 4/1956 | Holt |
| 2,841,807 | A | 7/1958 | Pullen |
| 3,181,193 | A | 5/1965 | Nobles et al. |
| 3,646,629 | A | 3/1972 | Bienek |
| 3,871,047 | A | 3/1975 | Kaburaki et al. |
| 4,207,641 | A | 6/1980 | Liebscher et al. |
| 4,403,371 | A | 9/1983 | Kiyooka |
| 4,627,127 | A | 12/1986 | Dupre |
| 4,654,916 | A | 4/1987 | Postonen et al. |
| 4,817,233 | A | 4/1989 | Waldhauser |
| 4,823,422 | A | 4/1989 | Yoshimura et al. |
| 4,835,807 | A | 6/1989 | Swift |
| 5,014,388 | A | 5/1991 | Schiazza et al. |
| 5,088,149 | A | 2/1992 | Berg et al. |
| 5,212,848 | A | 5/1993 | Geyer |
| 5,293,665 | A | 3/1994 | Worwag |
| 5,452,490 | A | 9/1995 | Brundula et al. |
| 5,557,822 | A | 9/1996 | Yagi et al. |
| 5,671,499 | A | 9/1997 | Melito et al. |
| 5,689,791 | A | 11/1997 | Swift |
| 5,715,565 | A | 2/1998 | Kern |
| 5,715,566 | A | 2/1998 | Weaver et al. |
| 5,896,611 | A | 4/1999 | Haaga |
| 5,960,514 | A | 10/1999 | Miller et al. |
| 6,009,301 | A | 12/1999 | Maher et al. |
| 6,030,464 | A | 2/2000 | Azevedo |
| 6,058,561 | A | 5/2000 | Song et al. |
| 6,079,080 | A | 6/2000 | Rutter et al. |
| 6,099,661 | A | 8/2000 | Conrad |
| 6,123,779 | A | 9/2000 | Conrad et al. |
| 6,154,920 | A | 12/2000 | Petrole et al. |
| 6,170,119 | B1 | 1/2001 | Conrad et al. |
| 6,266,838 | B1 | 7/2001 | Caruso |
| 6,311,366 | B1 | 11/2001 | Sepke et al. |
| 6,345,408 | B1 | 2/2002 | Nagai et al. |
| 6,513,190 | B1 | 2/2003 | Allgeier et al. |
| 6,662,402 | B2 | 12/2003 | Giddings et al. |
| 6,735,812 | B2 | 5/2004 | Hekman et al. |
| 6,742,220 | B2 | 6/2004 | Nagai et al. |
| 6,772,475 | B2 | 8/2004 | Weber et al. |
| 7,117,556 | B2 | 10/2006 | Grey |
| 7,134,160 | B2 | 11/2006 | Tawara et al. |
| 7,134,164 | B2 | 11/2006 | Alton |
| 7,272,870 | B2 | 9/2007 | Pierce et al. |
| 7,413,786 | B2 | 8/2008 | Wada et al. |
| 7,441,306 | B2 | 10/2008 | Kim |
| 7,716,784 | B2 | 5/2010 | Yang et al. |
| 7,827,653 | B1 | 11/2010 | Liu et al. |
| 7,937,801 | B2 | 5/2011 | Egler et al. |
| 7,967,914 | B2 | 6/2011 | Giddings et al. |
| 7,979,952 | B2 | 7/2011 | Beskow et al. |
| 7,987,552 | B2 | 8/2011 | Gordon et al. |
| 8,230,549 | B2 | 7/2012 | Lenkiewicz et al. |
| 8,240,000 | B2 | 8/2012 | Oh et al. |
| 8,316,503 | B2 | 11/2012 | Follows et al. |
| 8,402,600 | B2 | 3/2013 | Beskow et al. |
| 8,443,477 | B2 | 5/2013 | Jang et al. |
| 8,458,850 | B2 | 6/2013 | Kasper et al. |
| 8,595,897 | B2 | 12/2013 | Vines |
| 8,601,643 | B2 | 12/2013 | Eriksson |
| 8,631,538 | B2 | 1/2014 | Huffman |
| 8,671,515 | B2 | 3/2014 | Eriksson |
| 8,695,144 | B2 | 4/2014 | Jang et al. |
| 8,745,818 | B2 | 6/2014 | Iles et al. |
| 8,782,851 | B2 | 7/2014 | Follows et al. |
| 8,800,106 | B2 | 8/2014 | Bilek et al. |
| 8,806,710 | B2 | 8/2014 | Follows et al. |
| 8,925,141 | B2 | 1/2015 | Kim et al. |
| 9,066,640 | B2 | 6/2015 | Iles et al. |
| 9,173,536 | B2 | 11/2015 | Van Der Kooi et al. |
| 9,186,032 | B2 | 11/2015 | De Wit et al. |
| 9,192,273 | B2 | 11/2015 | Eriksson |
| 9,265,394 | B2 | 2/2016 | Van Der Kooi et al. |
| 9,289,105 | B2 | 3/2016 | Moes |
| 9,295,362 | B2 | 3/2016 | Eriksson |
| 9,295,364 | B2 | 3/2016 | Eriksson |
| 9,326,654 | B2 | 5/2016 | Doughty |
| 9,351,618 | B2 | 5/2016 | Van Der Kooi et al. |
| 9,351,619 | B2 | 5/2016 | Bosses |
| 9,357,895 | B2 | 6/2016 | Liefheit et al. |
| 9,375,122 | B2 | 6/2016 | Eriksson |
| 9,414,728 | B2 | 8/2016 | Van Der Kooi et al. |
| 9,427,128 | B2 | 8/2016 | DeJonge et al. |
| 9,451,856 | B2 | 9/2016 | Gray et al. |
| 9,456,723 | B2 | 10/2016 | Thorne et al. |
| 9,468,350 | B2 | 10/2016 | Tawara et al. |
| 9,504,366 | B2 | 11/2016 | Kasper et al. |
| 9,526,389 | B2 | 12/2016 | Thorne et al. |
| 9,648,999 | B2 | 5/2017 | Uphoff et al. |
| 9,655,486 | B2 | 5/2017 | Xu et al. |
| D790,785 | S | 6/2017 | Courtney et al. |
| 9,750,380 | B2 | 9/2017 | McVey |
| 9,770,148 | B2 | 9/2017 | Bosses |
| 9,770,151 | B2 | 9/2017 | Sun et al. |
| 9,826,869 | B2 | 11/2017 | Kettle Aiers et al. |
| 9,844,311 | B2 | 12/2017 | Zhang |
| 9,867,515 | B2 | 1/2018 | Ventress et al. |
| 9,949,605 | B2 | 4/2018 | Isley et al. |
| 9,955,832 | B2 | 5/2018 | Thorne et al. |
| 9,993,129 | B2 | 6/2018 | Santini |
| 9,999,332 | B2 | 6/2018 | Braendle et al. |
| 10,004,370 | B2 | 6/2018 | Isley et al. |
| 10,092,155 | B2 | 10/2018 | Xia et al. |
| 10,448,800 | B2 | 10/2019 | Weeks et al. |
| 2002/0038489 | A1 | 4/2002 | Paterson et al. |
| 2002/0194692 | A1 | 12/2002 | Giddings et al. |
| 2003/0088928 | A1 | 5/2003 | Shizuno et al. |
| 2004/0134025 | A1 | 7/2004 | Murphy et al. |
| 2004/0172769 | A1 | 9/2004 | Giddings et al. |
| 2005/0015916 | A1 | 1/2005 | Orubor |
| 2005/0273970 | A1 | 12/2005 | Cho et al. |
| 2005/0273971 | A1 | 12/2005 | Cho et al. |
| 2006/0236494 | A1 | 10/2006 | Nelson et al. |
| 2007/0204426 | A1 | 9/2007 | Nakagawa et al. |
| 2008/0022485 | A1 | 1/2008 | Grey |
| 2008/0047093 | A1 | 2/2008 | Gordon |
| 2008/0148512 | A1 | 6/2008 | Beskow et al. |
| 2008/0276414 | A1 | 11/2008 | Wood et al. |
| 2009/0151113 | A1 | 6/2009 | Sepke |
| 2009/0276975 | A1 | 11/2009 | Vines |
| 2009/0300873 | A1 | 12/2009 | Grey |
| 2010/0236010 | A1 | 9/2010 | Johnson |
| 2010/0306958 | A1 | 12/2010 | Follows et al. |
| 2010/0306959 | A1 | 12/2010 | Follows et al. |
| 2012/0137464 | A1 | 6/2012 | Thatcher et al. |
| 2013/0086769 | A1 | 4/2013 | Iles et al. |
| 2013/0139349 | A1 | 6/2013 | Iles et al. |
| 2013/0212831 | A1 | 8/2013 | Follows et al. |
| 2014/0026338 | A1 | 1/2014 | Kim et al. |
| 2014/0165328 | A1 | 6/2014 | Jang et al. |
| 2014/0182079 | A1 | 7/2014 | Van Der Kooi et al. |
| 2014/0215749 | A1 | 8/2014 | Van Der Kooi et al. |
| 2015/0238061 | A1 | 8/2015 | Adams et al. |
| 2015/0265116 | A1 | 9/2015 | Genn et al. |
| 2015/0327743 | A1 | 11/2015 | Van Der Kooi et al. |
| 2016/0058258 | A1 | 3/2016 | Isley et al. |
| 2016/0174792 | A1 | 6/2016 | Williamson et al. |
| 2016/0183749 | A1 | 6/2016 | Isley et al. |
| 2016/0213217 | A1 | 7/2016 | Doughty |
| 2016/0220084 | A1 | 8/2016 | Xu et al. |
| 2016/0256025 | A1 | 9/2016 | Van Der Kooi et al. |
| 2016/0278597 | A1 | 9/2016 | Braendle et al. |
| 2017/0119225 | A1 | 5/2017 | Xia et al. |
| 2017/0127896 | A1 | 5/2017 | Carter et al. |
| 2017/0190483 | A1 | 7/2017 | Giraud et al. |
| 2017/0215667 | A1 | 8/2017 | Thorne et al. |
| 2017/0215676 | A1 | 8/2017 | Moser et al. |
| 2017/0215678 | A1 | 8/2017 | Moser et al. |
| 2017/0290483 | A1 | 10/2017 | Dobson |
| 2017/0340180 | A1 | 11/2017 | Isley et al. |
| 2017/0347848 | A1 | 12/2017 | Carter et al. |
| 2018/0110388 | A1 | 4/2018 | Xia et al. |
| 2018/0255992 | A1 | 9/2018 | Isley et al. |

(56) References Cited

U.S. PATENT DOCUMENTS

| | | | |
|---|---|---|---|
| 2018/0325341 | A1 | 11/2018 | Xia et al. |
| 2018/0353026 | A1 | 12/2018 | Fogarty, Jr. et al. |
| 2019/0029482 | A1 | 1/2019 | Grey et al. |
| 2019/0082903 | A1 | 3/2019 | Conrad et al. |
| 2020/0069137 | A1 | 3/2020 | Nguyen |
| 2021/0100419 | A1 | 4/2021 | Nguyen et al. |

FOREIGN PATENT DOCUMENTS

| | | | |
|---|---|---|---|
| CN | 201861565 | U | 6/2011 |
| CN | 202636836 | U | 1/2013 |
| CN | 202665458 | U | 1/2013 |
| CN | 203042131 | U | 7/2013 |
| CN | 203074569 | U | 7/2013 |
| CN | 103505152 | B | 1/2014 |
| CN | 204105900 | U | 1/2015 |
| CN | 204427936 | U | 7/2015 |
| CN | 204931585 | U | 1/2016 |
| CN | 205126111 | U | 4/2016 |
| CN | 205286240 | U | 6/2016 |
| CN | 106137053 | A | 11/2016 |
| CN | 106343922 | A | 1/2017 |
| CN | 106419732 | A | 2/2017 |
| CN | 206183180 | U | 5/2017 |
| CN | 206285050 | U | 6/2017 |
| CN | 206354993 | U | 7/2017 |
| CN | 107495904 | A | 12/2017 |
| CN | 206934044 | U | 1/2018 |
| CN | 207084765 | U | 3/2018 |
| CN | 207734104 | U | 8/2018 |
| DE | 8705639 | U1 | 6/1987 |
| DE | 202012103979 | U1 | 2/2014 |
| DE | 102015104235 | A1 | 9/2016 |
| DE | 102015114082 | A1 | 3/2017 |
| EP | 0186005 | A1 | 7/1986 |
| EP | 2842473 | A2 | 3/2015 |
| EP | 2941994 | A1 | 11/2015 |
| GB | 1023556 | A | 3/1966 |
| GB | 1321081 | A | 6/1973 |
| GB | 2419809 | A | 5/2006 |
| JP | H03949 | | 1/1991 |
| JP | 3603994 | B2 | 8/2000 |
| JP | 2004222912 | A | 8/2004 |
| JP | 2005027807 | A | 2/2005 |
| JP | 2009268684 | A | 11/2009 |
| WO | 8701266 | A1 | 3/1987 |
| WO | 9528119 | A1 | 10/1995 |
| WO | 9848685 | A1 | 11/1998 |
| WO | 9943250 | A1 | 9/1999 |
| WO | 2010041184 | A1 | 4/2010 |
| WO | 2015124310 | A1 | 8/2015 |
| WO | 2015124311 | A1 | 8/2015 |
| WO | 2017064459 | A1 | 4/2017 |
| WO | 2017064462 | A1 | 4/2017 |
| WO | 2017064464 | A1 | 4/2017 |
| WO | 2017194946 | A1 | 11/2017 |

OTHER PUBLICATIONS

International Search Report and Written Opinion for Application No. PCT/US2019/048178 dated Feb. 5, 2020 (17 pages).

Chinese Patent Office Action for Application No. 201980044200.8 dated Jul. 21, 2021 (14 pages including statement of relevance).

Examination Report No. 1 issued by the Australian Government for Application No. 2019327393 dated Aug. 13, 2021 (4 pages).

Chinese Patent Office Action for Application No. 201980044200.8 dated Mar. 22, 2022 (12 pages including statement of relevance).

FLOOR CLEANER

CROSS-REFERENCE TO RELATED APPLICATIONS

This application is a continuation of U.S. patent application Ser. No. 16/551,485, filed Aug. 26, 2019, which granted as U.S. Pat. No. 11,291,345, Apr. 5, 2022, which claims priority to U.S. Provisional Patent Application No. 62/723,345, filed Aug. 27, 2018, the entire contents all of which are hereby incorporated by reference herein.

BACKGROUND

The present invention relates to floor cleaners.

SUMMARY

In one embodiment the invention provides a floor cleaner including a supply tank configured to store a cleaning fluid, a distribution nozzle in fluid communication with the supply tank, the distribution nozzle configured to dispense the cleaning fluid onto a surface to be cleaned. The floor cleaner further includes a vacuum source and a base movable over the surface to be cleaned. The base includes a front side, a back side opposite the front side, a lower end configured to be adjacent the surface to be cleaned, a suction inlet adjacent the front side and adjacent the lower end of the base and in fluid communication with the vacuum source, a brushroll rotatable about a brushroll axis, a first squeegee that extends from the lower end between the suction inlet and the back side of the base, the first squeegee configured to contact the surface to be cleaned. The base further includes a second squeegee that contacts the brushroll and the brushroll axis is between the lower end of the base and the second squeegee.

In another embodiment, the invention provides a floor cleaner including a vacuum source and a base movable over the surface to be cleaned, the base including a brushroll rotatable about a brushroll axis. The brushroll includes a first set of fibers, each fiber having a diameter in a range from about 0.04 millimeters to about 0.08 millimeters, and a second set of fibers that wrap around the brushroll axis in a helical pattern. Each fiber of the second set of fibers has a diameter of at least 0.06 millimeters and the fibers of the first set of fibers have a diameter that is smaller than the diameter of the fibers of the second set of fibers.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Layout

Figure 1:
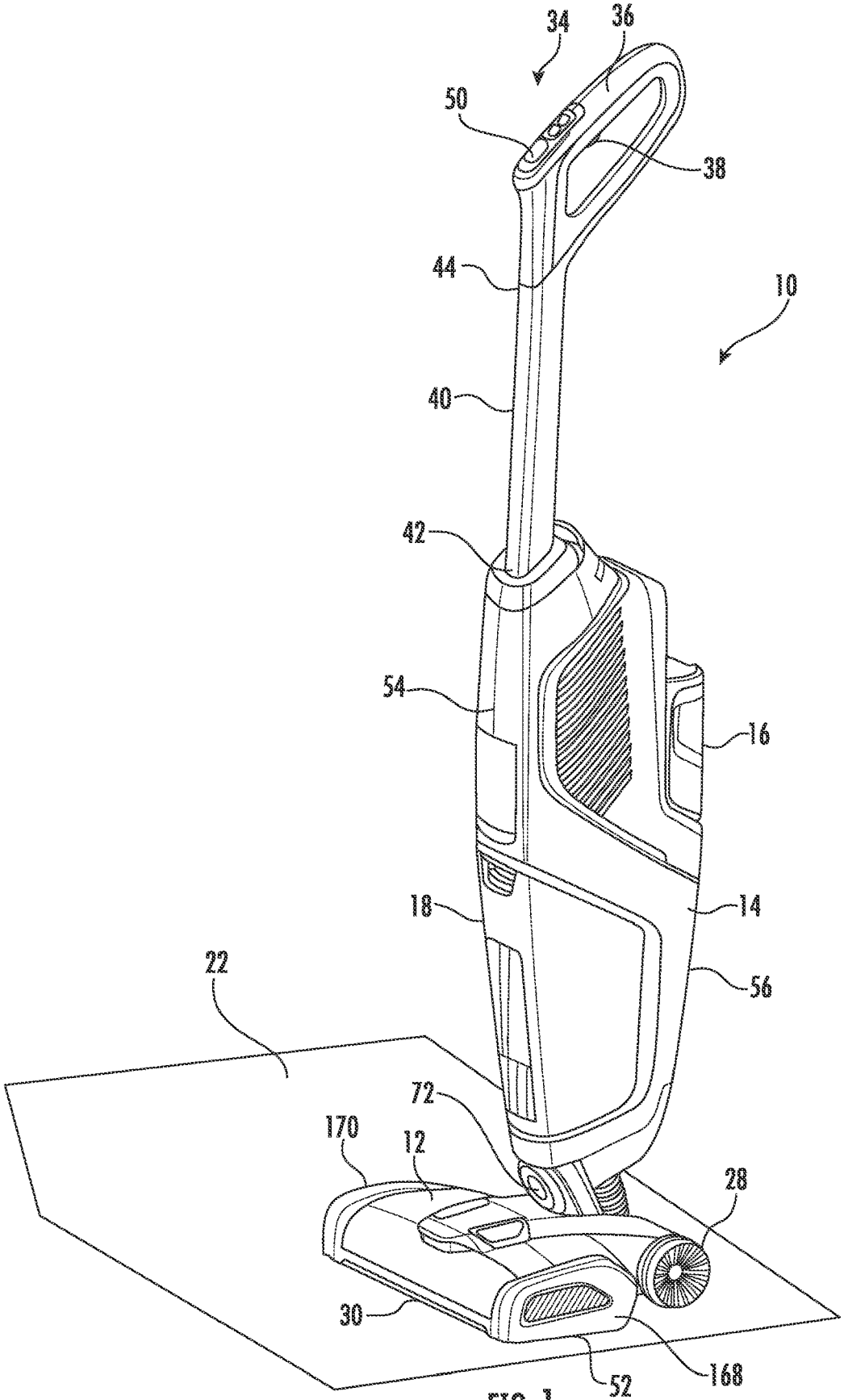
FIG. 1 is a perspective view of a floor cleaner according to one embodiment.

FIG. 1 illustrates a floor cleaner 10. In the illustrated embodiment, the floor cleaner 10 includes a base 12 and a body 14 pivotally coupled to the base 12. The body 14 is pivotal relative the base 12 about a first axis 160 (FIG. 3) between an upright storage position (FIG. 1) and an inclined operating position. The floor cleaner 10 further includes a supply tank 16, a recovery tank 18, and a vacuum source 20. The supply tank 16 is configured to store a cleaning fluid and the floor cleaner 10 is operable to dispense the cleaning fluid onto a surface 22 to be cleaned. Referring to FIG. 4, the vacuum source 20 includes a motor 24 and a fan 26. The motor 24 and the fan 26 are operable to draw the cleaning fluid from the surface 22 into the recovery tank 18.

The base 12 is movable over the surface 22 to be cleaned. In the illustrated embodiment, the base 12 includes wheels 28 to facilitate moving the base 12 over the surface 22. The base 12 includes a suction inlet 30 in fluid communication with the vacuum source 20 and the recovery tank 18. The cleaning fluid is drawn from the surface 22 through the suction inlet 30 and into the recovery tank 18. The base 12 further includes a distribution nozzle 32 in fluid communication with the supply tank 16. The distribution nozzle 32 dispenses the cleaning fluid toward the surface 22.

The floor cleaner 10 further includes a handle 34. The handle 34 includes a grip 36 and an actuator 38 adjacent the grip 36. The grip 36 is grabbed by the user to move the floor cleaner 10 along the surface 22 and to pivot the body 14 relative to the base 12. The actuator 38 controls the flow of cleaning fluid from the supply tank 16 through the distribution nozzle 32. The handle 34 further includes an extension 40 that extends from the body 14. The extension 40 includes a first end 42, a second end 44, and a handle axis 46 that extends centrally through the first end 42 and the second end 44 as illustrated in FIG. 4. The first end 42 is coupled to and adjacent the body 14. The second end 44 is adjacent the grip 36.

The floor cleaner 10 further includes a battery 48 (FIG. 4) that provides power to the vacuum source 20. The battery 48 is a rechargeable lithium-ion battery in one embodiment.

Referring to FIGS. 1-4, the floor cleaner 10 further includes an upper end 50 and a lower end 52 opposite the upper end 50. The handle 34 is adjacent the upper end 50 and the base 12 is adjacent the lower end 52. The floor cleaner 10 further include a front side 54 and a back side 56 opposite the front side 54. The suction inlet 30 is adjacent the front side 54.

The relative positions of the components of the floor cleaner 10 will be discussed below. It has been found that the disclosed relative positioning of the components provides the floor cleaner 10 that is well balanced and comfortable for the operator to control while the floor cleaner 10 is moved along the surface 22. Referring to FIG. 4, when the supply tank 16 is full of cleaning fluid and the recovery tank 18 is empty, the floor cleaner 10 has a center of gravity 58. When the supply tank 16 is partially full and the recovery tank 18 is partially full, the floor cleaner 10 has a center of gravity 60. When the supply tank 16 is empty and the recovery tank 18 is full, the floor cleaner 10 has a center of gravity 62. Regardless of the fill levels in the tanks 16, 18, the center of gravities 58, 60, 62 are located behind the handle axis 46 and generally along a center of gravity axis 64 that is behind the handle axis 46 and extending through the body 14. In the illustrated embodiment, the body 14 is coupled to the base 12 along a steering axle 72 forming a second axis 166 about which the body 14 is rotatable by the user holding the hand grip about a steering axis extending from the grip 36 to the steering axle 72. In one embodiment, the center of gravity axis 64 is along or rearward of the steering axis as further discussed below.

In one possible embodiment, the center of gravity configurations discussed above are achieved by arranging the components as follows. The vacuum source 20 has a center of gravity 66. The motor 24 of the vacuum source 20 is between the recovery tank 18 and the battery 48 in a direction from the lower end 52 to the upper end 50. The handle 34 and the extension 40 are adjacent the front side 54.

The battery 48 has a center of gravity 68 and the battery 48 is adjacent the back side 56. The battery 48 is between the back side 56 and the handle axis 46 in a direction from the front side 54 to the back side 56. The battery 48 is also between the supply tank 16 and the front side 54 in a direction from the front side 54 to the back side 56. The battery 48 is also between the supply tank 16 and the motor 24 in a direction from the front side 54 to the back side 56. The battery 48 is also between the motor 24 and the upper end 50 in the direction from the lower end 52 to the upper end 50. The battery 48 is also closer to the upper end 50 than the recovery tank 18 and the supply tank 16 in a direction from the upper end 50 to the lower end 52. The battery 48 is also between the upper end 50 and the supply tank 16 in a direction from the upper end 50 to the lower end 52.

Figure 2:
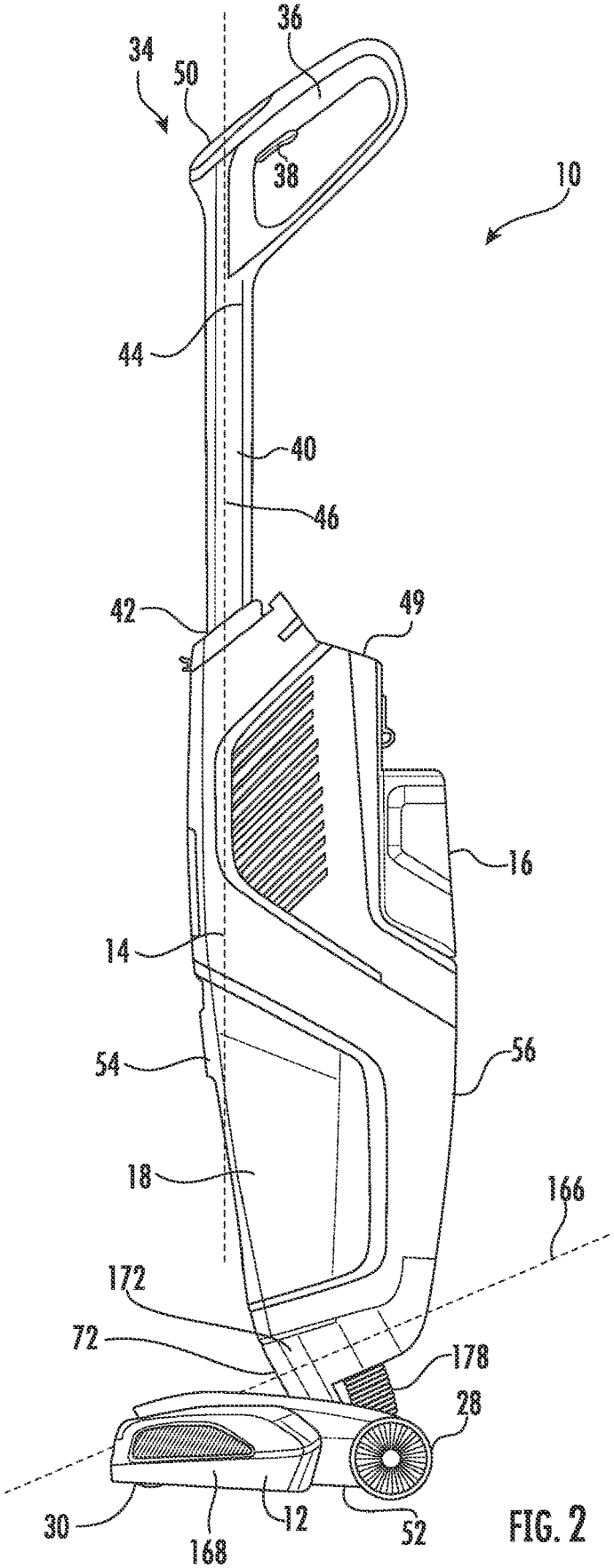
FIG. 2 is a side view of the floor cleaner of FIG. 1.
Figure 3:
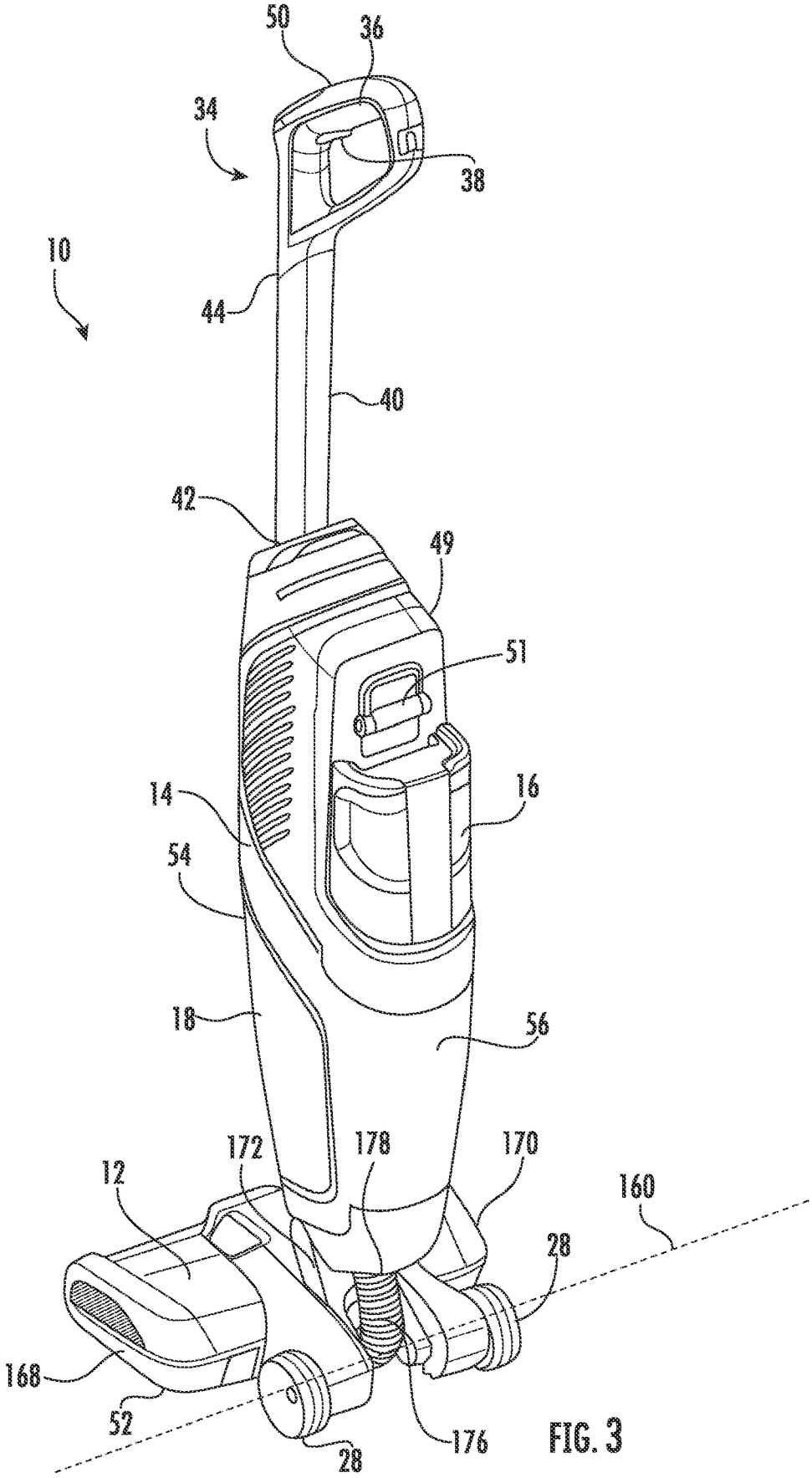
FIG. 3 is a rear perspective view of the floor cleaner of FIG. 1.
Figure 4:
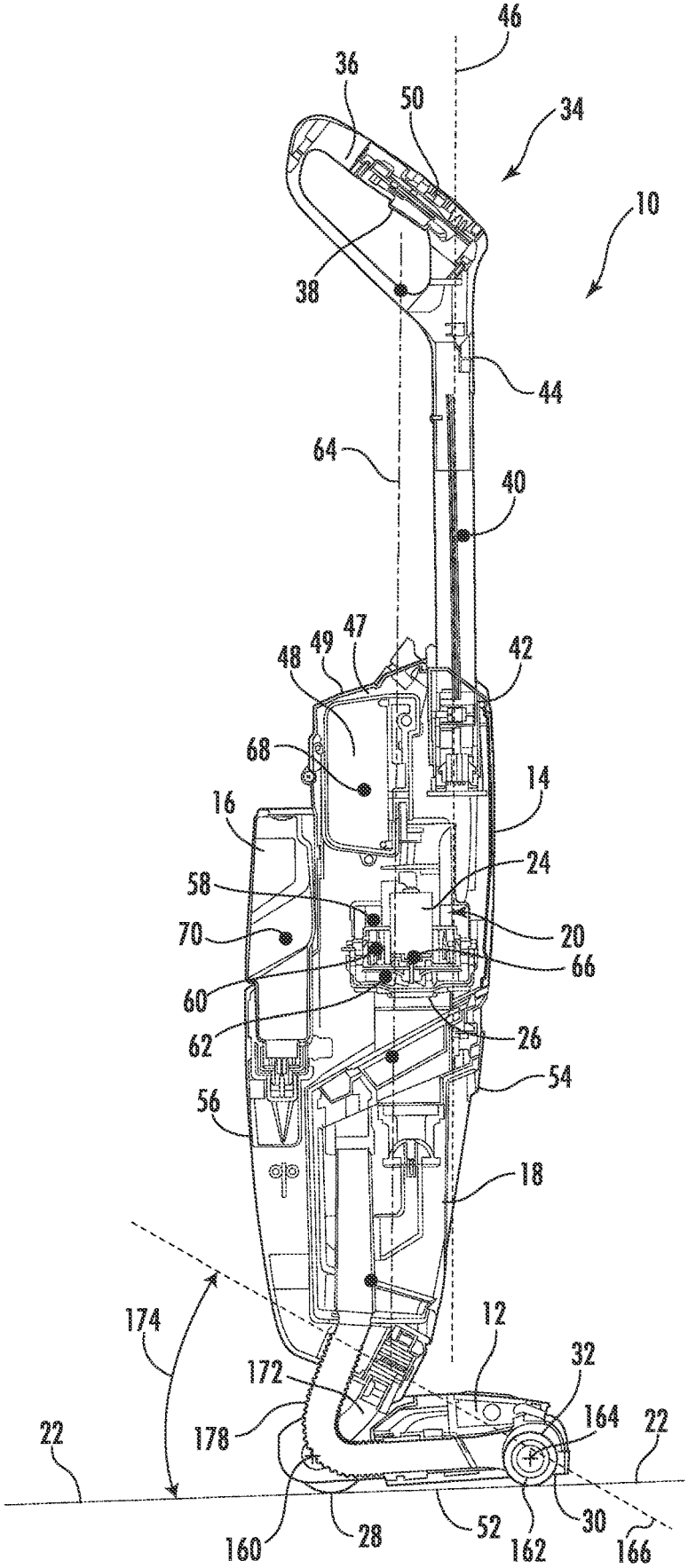
FIG. 4 is a cross-sectional view of the floor cleaner of FIG. 1.

Referring to FIGS. 3 and 4, the battery 48 is stored in a battery chamber 47, the battery chamber 47 having an opening through which the battery 48 may be removed or replaced within the battery chamber 47. A battery door 49 is coupled to an edge of the opening of the battery chamber 47, the battery door 49 being configured to cover and provide access to an interior of the battery chamber 47. In the illustrated embodiment, the battery door 49 is pivotably coupled about an edge of the opening by a hinge 51 and configured to pivot between a closed position and an open position providing access to an interior of the battery chamber 47. In one embodiment, the battery door 49 pivots open in a direction toward the back side 56 of the floor cleaner 10 upon being opened by a user. The battery door 49 may be spring-loaded, wherein the battery door 49 automatically pivots toward the closed position upon being released from an opened position by a user. In the illustrated embodiment, the battery 48 moves into and out of the battery chamber 47 in a direction along the handle axis 46 when the battery door 49 is open. The handle axis 46 is positioned generally upright when the floor cleaner 10 is in the upright storage position (FIG. 2). By positioning the battery 48 upright within the battery chamber 47 while the floor cleaner 10 is in an upright storage position, replacement of the battery 48 into the battery chamber 47 may be gravity-assisted.

In one embodiment (not shown), the locations of the battery 48 and supply tank 16 shown in FIG. 4 are exchanged such that the supply tank 16 is between the battery 48 and the front side 54 in a direction from the front side 54 to the back side 56 and the supply tank 16 is also between the battery 48 and the motor 24 in a direction from the front side 54 to the back side 56.

The supply tank 16 has a center of gravity 70 when full. The supply tank 16 is adjacent the back side 56 and the supply tank 16 defines a portion of the back side 56. The supply tank 16 is between the back side 56 and the battery 48 in the direction from the front side 54 to the back side 56.

The recovery tank 18 is adjacent the front side 54 and the recovery tank 18 forms a portion of the front side 54. The handle axis 46 extends through the recovery tank 18. The recovery tank 18 is between the lower end 52 and the supply tank 16 in the direction from the upper end 50 to the lower end 52.

It should be understood that modifications to the locations of the components discussed above could be made while still achieving the desired results of the center of gravity locations that provide the floor cleaner 10 that is well balanced and comfortable for the operator to control while the cleaner is moved along the surface 22.

Recovery Tank Float and Strainer

Figure 9:
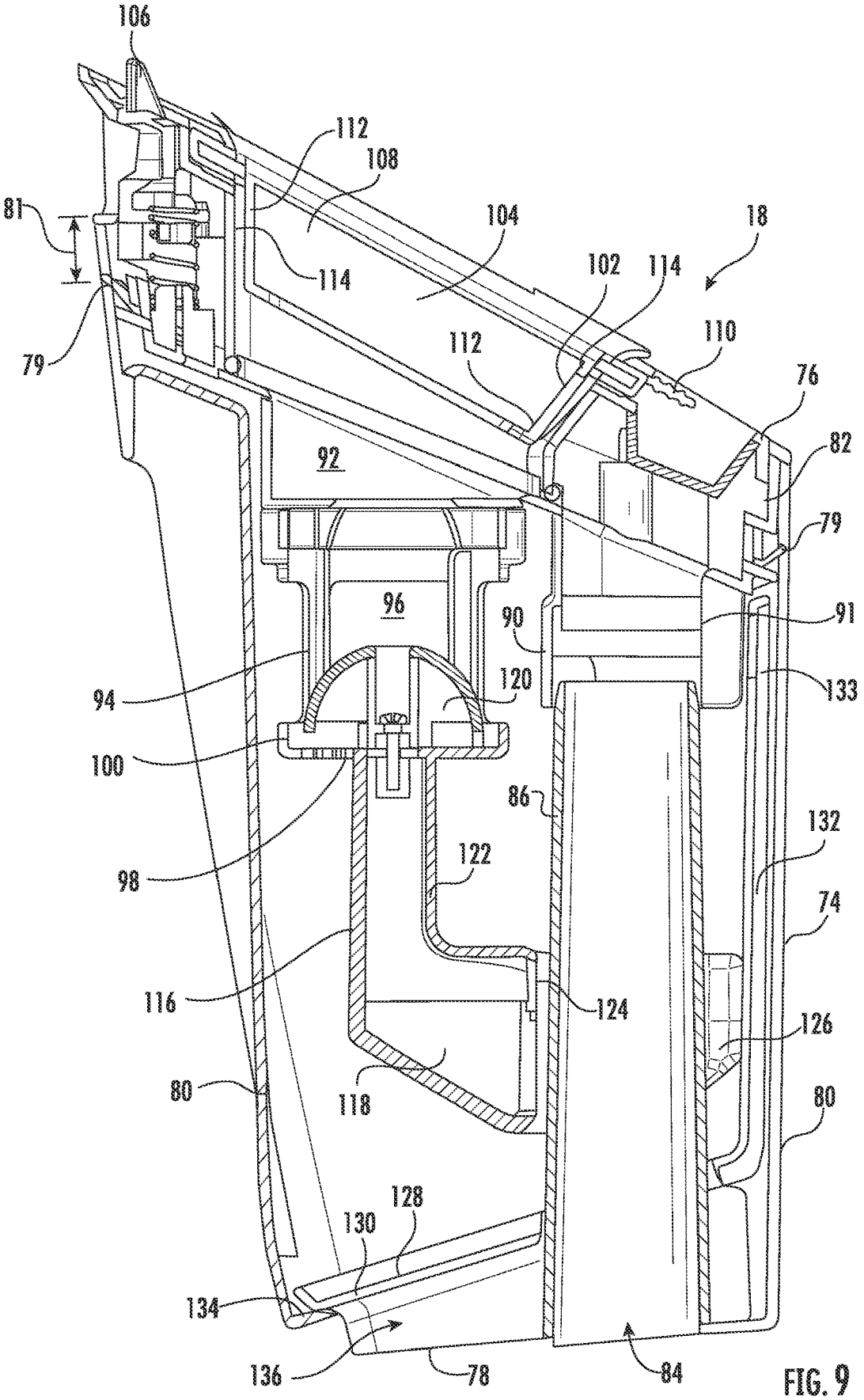
FIG. 9 is a cross-sectional view of the recovery tank of FIG. 7.
Figure 10:
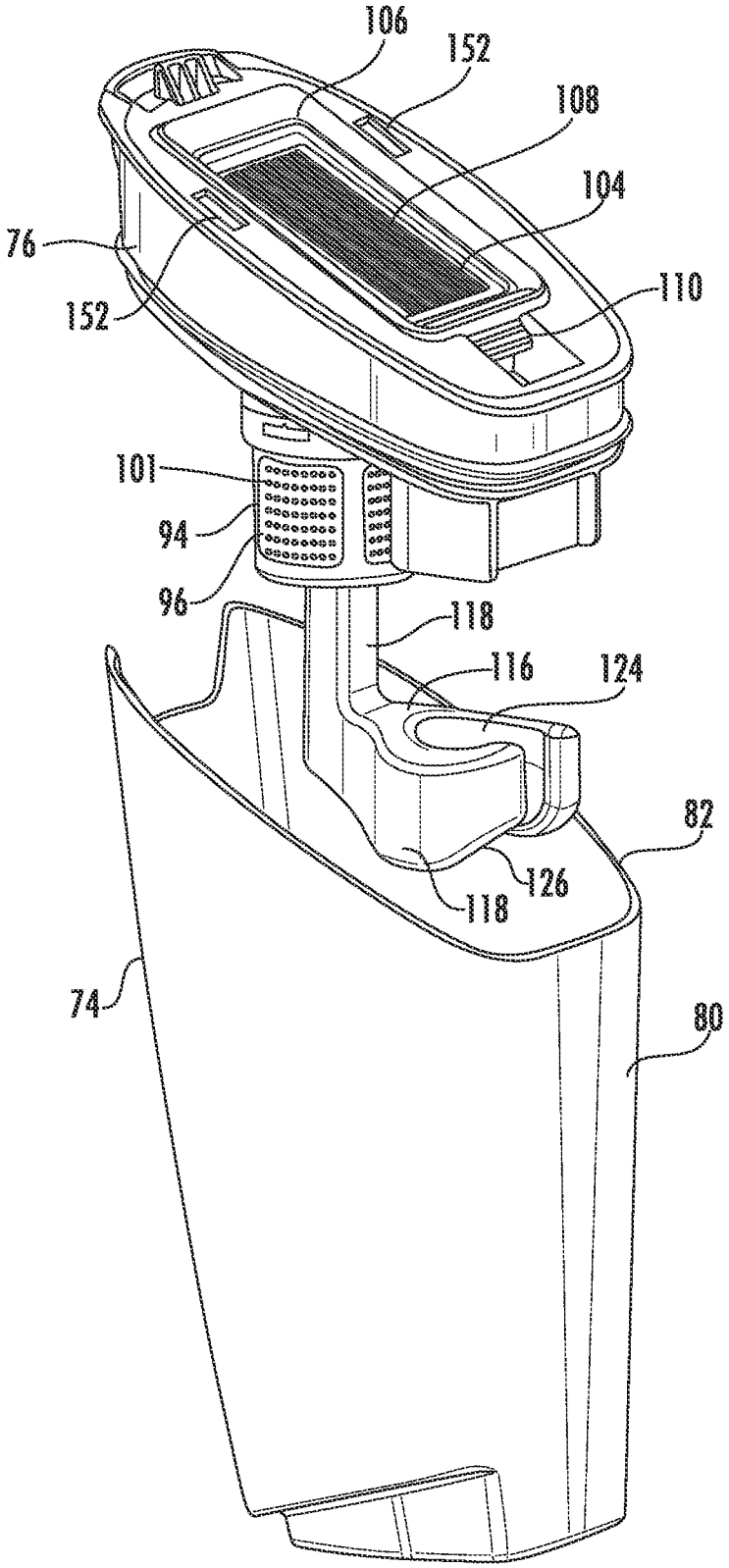
FIG. 10 is a partially exploded view of the recovery tank of FIG. 7.
Figure 11:
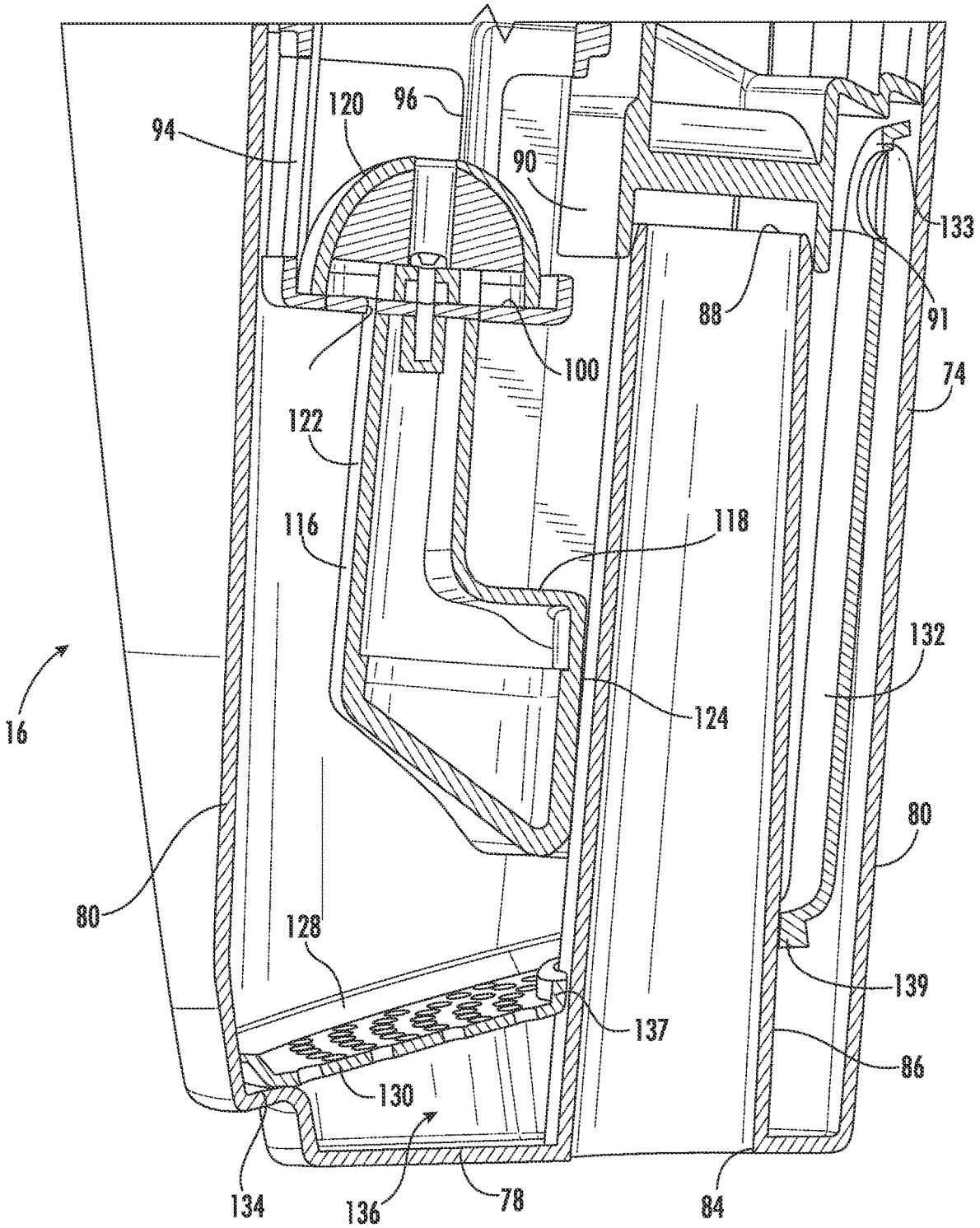
FIG. 11 is a partial cross-sectional view of the recovery tank of FIG. 7.
Figure 12:
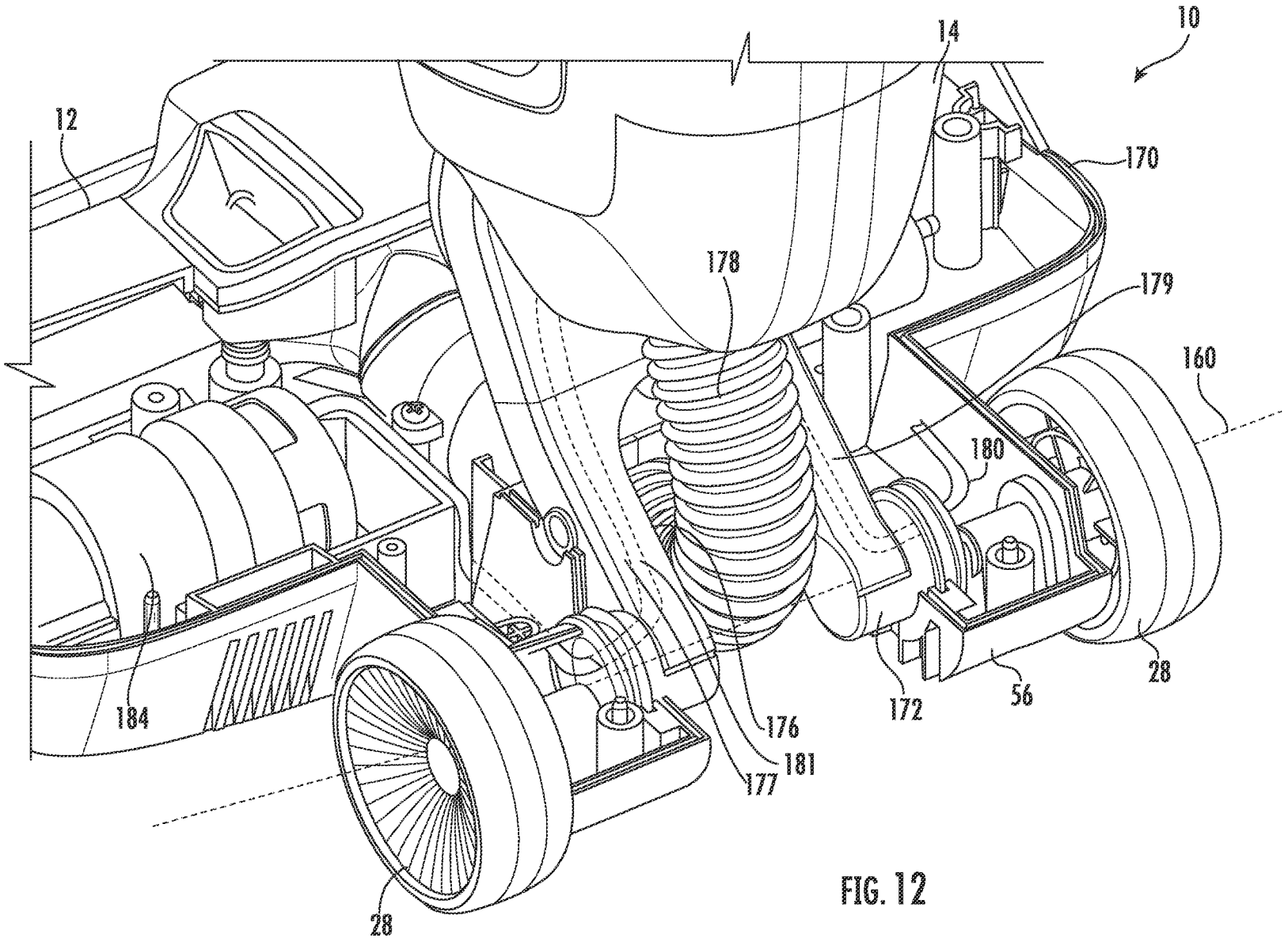
FIG. 12 is a perspective view of a portion of the floor cleaner of FIG. 1 with a portion of a base cover removed.

Referring to FIGS. 9-11, the recovery tank 18 includes a tank body 74 and a cover 76 coupled to the tank body 74. The tank body 74 has a lower end wall 78 and a sidewall 80 that extends upwardly from the lower end wall 78 to an open upper end 82 of the tank body 74. The lower end wall 78 includes an inlet aperture 84 and an inlet duct 86 that extends upwardly from the lower end wall 78. The inlet duct 86 includes an outlet 88 at an end of the duct 86 opposite the inlet aperture 84. Air and fluid enter the recovery tank 18 through the inlet duct 86 and through the outlet 88 of the inlet duct 86. In the illustrated embodiment, the inlet duct 86 decreases in diameter in a direction extending upwardly from the lower end wall, wherein the diameter of the inlet aperture 84 is greater than the diameter of the outlet 88.

The cover 76 is removably coupled to the open upper end 82 of the tank body 74 to close the open upper end 82 of the tank body 74. The cover 76 is removable for emptying the tank body 74 when full. The cover 76 includes a lid seal 79 around the perimeter of the cover between the sidewall 80 and the cover 76. The lid seal 79 is positioned offset from the upper end 82 toward the lower end wall 78 a desired distance providing sealing engagement for a distance 81 of the travel of the cover 76 lifting from the open upper end 82 of the tank body 74. The cover 76 includes a baffle 90 that surrounds the outlet aperture 88 of the inlet duct 86. The baffle 90 includes one or more arcuate redirecting surfaces 93 configured to turn the air and fluid from the outlet 88 of the inlet duct 86 toward the lower end wall 78. More specifically, redirecting the airflow from an upwardly directed flow along the inlet duct 86 to a downwardly directed flow toward the lower end wall 78 and/or sidewalls 80. In the illustrated embodiment, the baffle includes two arcuate redirecting surfaces 93, dividing the airflow from the outlet aperture 88 and redirecting the divided airflows to downwardly directed flows toward the lower end wall 78 and/or sidewalls 80. The arcuate redirecting surface 93 has an arc angle 95 greater than 120 degrees. In the illustrated embodiment, the arcuate redirecting surface 93 has an arc angle 95 greater than 150 degrees. The baffle 90 facilitates separation of the fluid from the suction airflow and directs the fluid down toward the lower end wall 78 of the tank body. In the illustrated embodiment, the baffle 90 extends in a direction toward the lower end wall 78 past or overlapping the outlet 88 and surrounding a portion of the inlet duct 86. The cover 76 also includes a suction air outlet 92 in fluid communication with the vacuum source 20. Air exits the recovery tank 18 through the air outlet 92. The baffle 90 inhibits cleaning fluid from traveling directly into the suction air outlet 92. The cover 76 further includes a cage 94 that surrounds the suction air outlet 92. The cage 94 includes side apertures 96 and a bottom aperture 98. A lip 100 surrounds the bottom aperture 98. The side apertures 96 may include a screen(s) 101 (FIG. 10) that filters the suction air flow before the suction airflow passes through the suction air outlet 92. The screen 101 includes screen openings providing an open area between 35% and 60% open. In one embodiment, the screen openings provide an open area between 40% and 45% open. In one embodiment, the cage 94 is releasably coupled to the cover 76 such as by a quarter-turn lock, hinge, or other latching arrangement to allow a user to open or remove the cage 94 for cleaning or maintenance.

The cover 76 further includes a filter aperture 102 in fluid communication with the vacuum source 20 and downstream from the suction air outlet 92. A filter 104 is received in the filter aperture 102 to filter the suction airflow before passing through the vacuum source 20. The filter includes a frame 106 and filter media 108. The frame 106 includes a tab 110 that is pulled upwardly to remove the filter 104 from the filter aperture 102 for replacement or for emptying the recovery tank 18. The frame 106 includes sidewalls 112 that are received in the filter aperture 102. The sidewalls 112 of the filter 104 are angled away from sidewalls 114 of the filter aperture 102, i.e., the sidewalls 112 are chamfered such that the length of the filter on the upstream side is shorter than the length of the filter on the downstream side. The relative angle between the walls 112, 114 inhibits binding of the filter 104 in the filter aperture 102 and allows for pivoting of the filter 104 within the filter aperture 102 when the filter 104 is removed by a user pulling only the single tab 110 using one hand. In addition, the sidewalls 112 of the filter 104 are not perpendicular to the plane of the filter, instead are angled inwardly toward the filter media 108. The filter media 108 can include any suitable filter media (e.g., paper or other cellulosic media). In one embodiment, the filter media 108 is pleated and includes a water repellant or resistant coating.

The recovery tank 18 further includes a shutoff float 116. The shutoff float 116 includes a float body 118, a closure 120, and an extension 122 that extends between the closure 120 and the float body 118 to space the closure 120 from the float body 118. Therefore, the closure 120 is positioned further from the surface of the fluid in the recovery tank 18 and the fluid is less likely to be drawn through the suction air outlet 92. The float body 118 floats on the surface of the fluid in the recovery tank 18 and the closure 120 is raised until the closure 120 is received in the suction air outlet 92 to close the suction air outlet 92 when the surface of the liquid exceeds a desired level. The float body 118 includes an aperture 124 extending through the float body 118. The inlet duct 86 extends through the aperture 124 of the float body 118 such that the float body 118 surrounds at least a portion of the inlet duct 86 so that the inlet duct 86 guides movement of the shutoff float 116 as the closure 120 travels toward and away from the suction air outlet 92 along the inlet duct. The float body 118 also includes a chamfered bottom surface 126 configured to float on the surface of the fluid in the recovery tank 18. The angle of the chamfered bottom surface 126 is approximately the angle of the body 14 relative to the surface 22 when the body 14 is in an inclined operating position. Therefore, the chamfered bottom surface 126 is approximately parallel to and in contact with the surface of the fluid in the recovery tank 18 when the handle is in a selected inclined operating position. In operation, the shutoff float 116 moves between a lowermost position where the closure 120 is distanced from the suction airflow outlet 92 and a uppermost position where the closure 120 closes the suction airflow outlet 92. The lip 100 of the cage 94 contacts and retains the closure 120 to limit downward movement of the shutoff float 116 to the lowermost position.

The recovery tank 18 further includes a strainer 128. The strainer 128 is positioned inside the tank body 74 and the strainer 128 moves relative to the tank body 74 from a lowermost position (FIG. 11) to a removed position outside the tank body 74 through the open upper end 82 of the tank body 74. The strainer 128 is used to strain debris from the fluid in the tank body 74. The strainer 128 includes a perforated body 130 and a handle 132 that extends from the perforated body 130. The handle 132 includes a grip portion 133 adjacent the open upper end 82 for accessibility when the cover 76 is removed from the recovery tank. In the illustrated embodiment, the baffle 90 extends past the outlet 88 of the inlet duct 86 to direct entering fluid toward the lower end wall 78 and away from the handle 132 of the strainer. More specifically, the baffle 90 includes a rear wall 91 positioned to inhibit splashing of water against the grip portion 133 of the handle 132 to keep the grip portion relatively clean. In an alternative embodiment, a portion of the baffle 90 proximate the handle 132 extends farther toward the lower end wall 78 than the remaining portions of the baffle 90 to redirect fluid away from the handle 132.

Figure 10A:
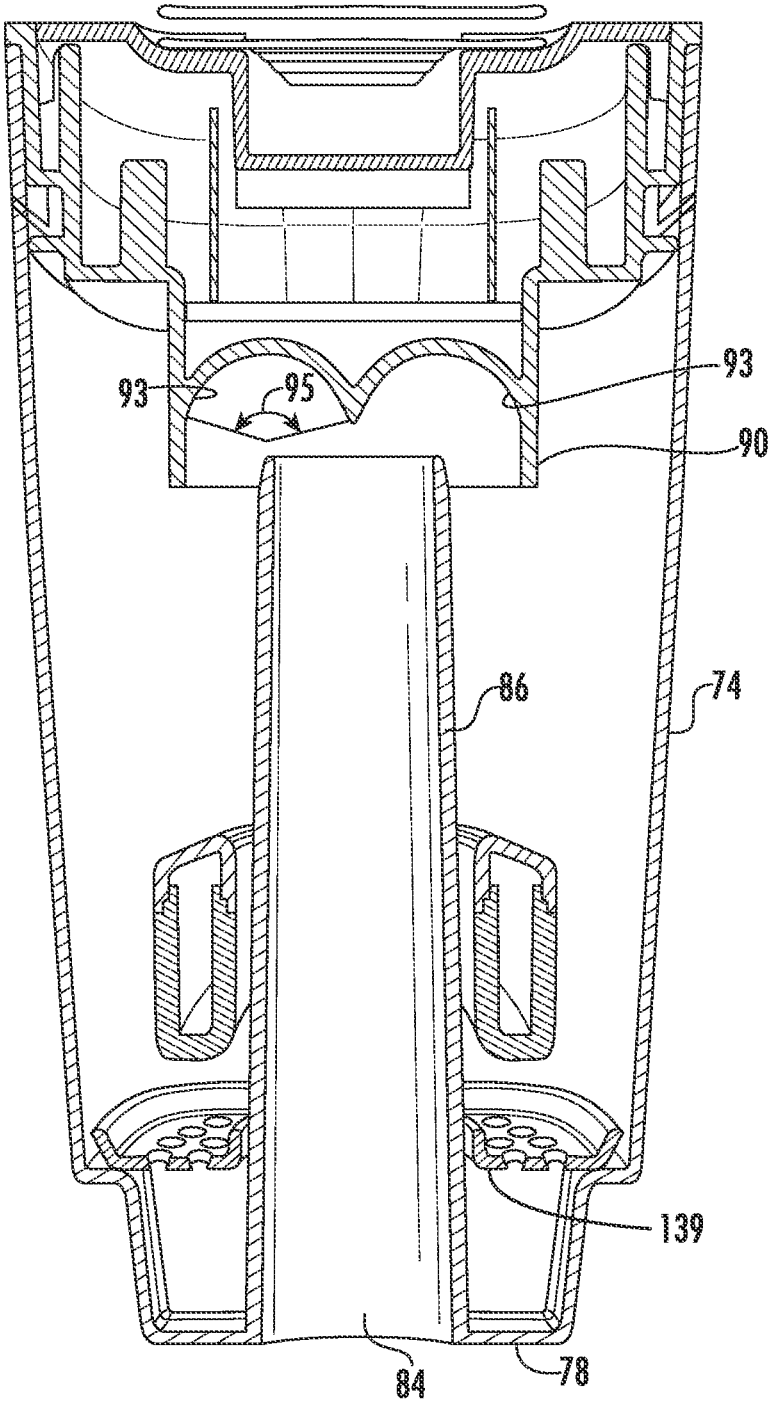
FIG. 10A is an alternative cross-sectional view of the recovery tank of FIG. 7.

The tank body 74 includes a strainer lip 134. As shown in FIG. 11, when the strainer 128 is in the lowermost position, the perforated body 130 contacts the lip 134 to space the perforated body 130 from the lower end wall 78 of the tank body 74 to define a gap 136 between the perforated body 130 and the lower end wall 78. Also when the strainer 128 is in the lowermost position, the handle 132 of the strainer 134 is between the inlet duct 86 and the sidewall 80 of the tank body 74 and the perforated body 130 is not parallel to the lower end wall 78. The perforated body 130 includes an aperture 137 and the inlet duct 86 extends through the aperture 137 to position the strainer 128 in the tank body 74. In one embodiment, the aperture 137 is sized and/or shaped to engage an outer surface of the inlet duct 86 in the installed position of the strainer in frictional engagement, retaining the strainer 134 onto the inlet duct 86 when the recovery tank 18 is inverted. In an embodiment shown in FIG. 10A, the aperture 137 includes one or more protrusions 139 configured to frictionally engage the outer surface of the inlet duct 86 holding the strainer 128 in place at a diameter of the inlet duct 86 corresponding to the installed position of the strainer. The strainer may be retained with a frictional fit or by coupling engagement between the inlet duct and the strainer.

The recovery tank 18 includes a tank handle 77 on the front side 54 (FIG. 6) configured for supporting and lifting the recovery tank 18 and optionally for use in lifting the floor cleaner 10. In the illustrated embodiment, the tank handle 77 is inset in the front side 54 of the recovery tank 18 to provide a smooth form to the front side 54 of floor cleaner 10, wherein forward space is conserved by not having the tank handle 77 extend out from the front side 54.

Tank Retention

Figure 5:
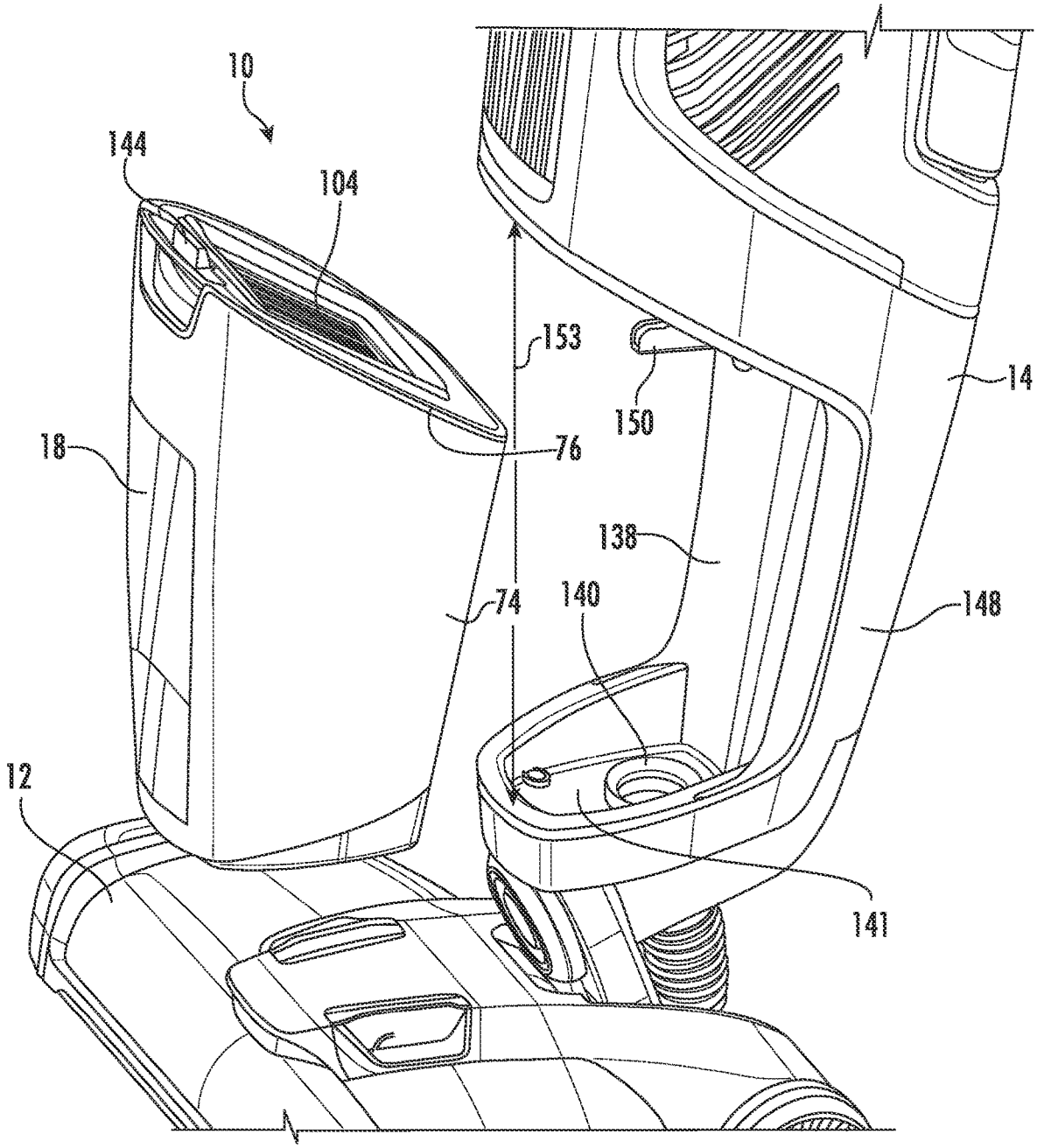
FIG. 5 is a partial view of the floor cleaner of FIG. 1 illustrated a recovery tank removed from the floor cleaner.
Figure 6:
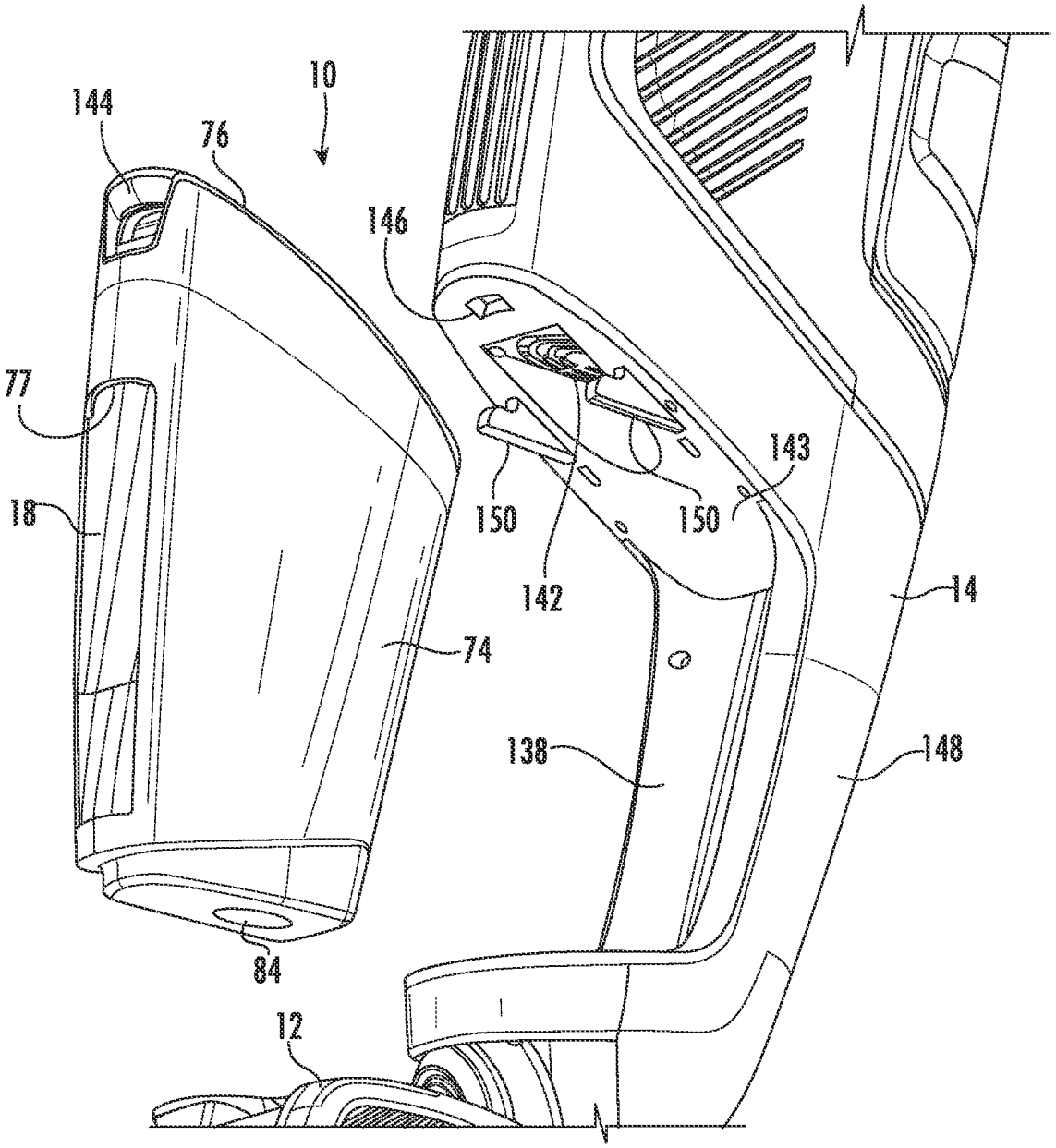
FIG. 6 is an alternative partial view of the floor cleaner of FIG. 1 illustrating the recovery tank removed.
Figure 7:
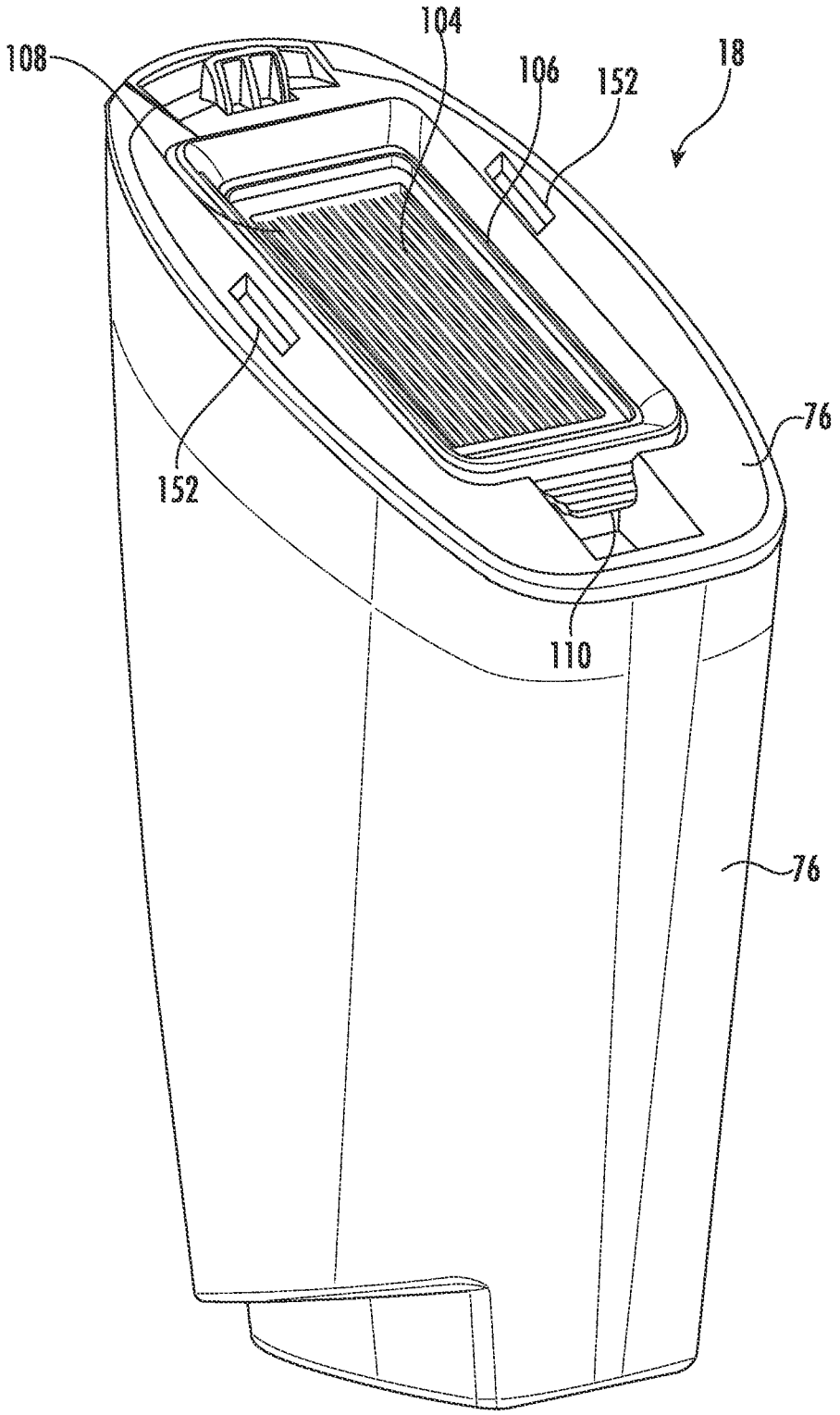
FIG. 7 is a perspective view of the recovery tank of the floor cleaner of FIG. 1.
Figure 8:
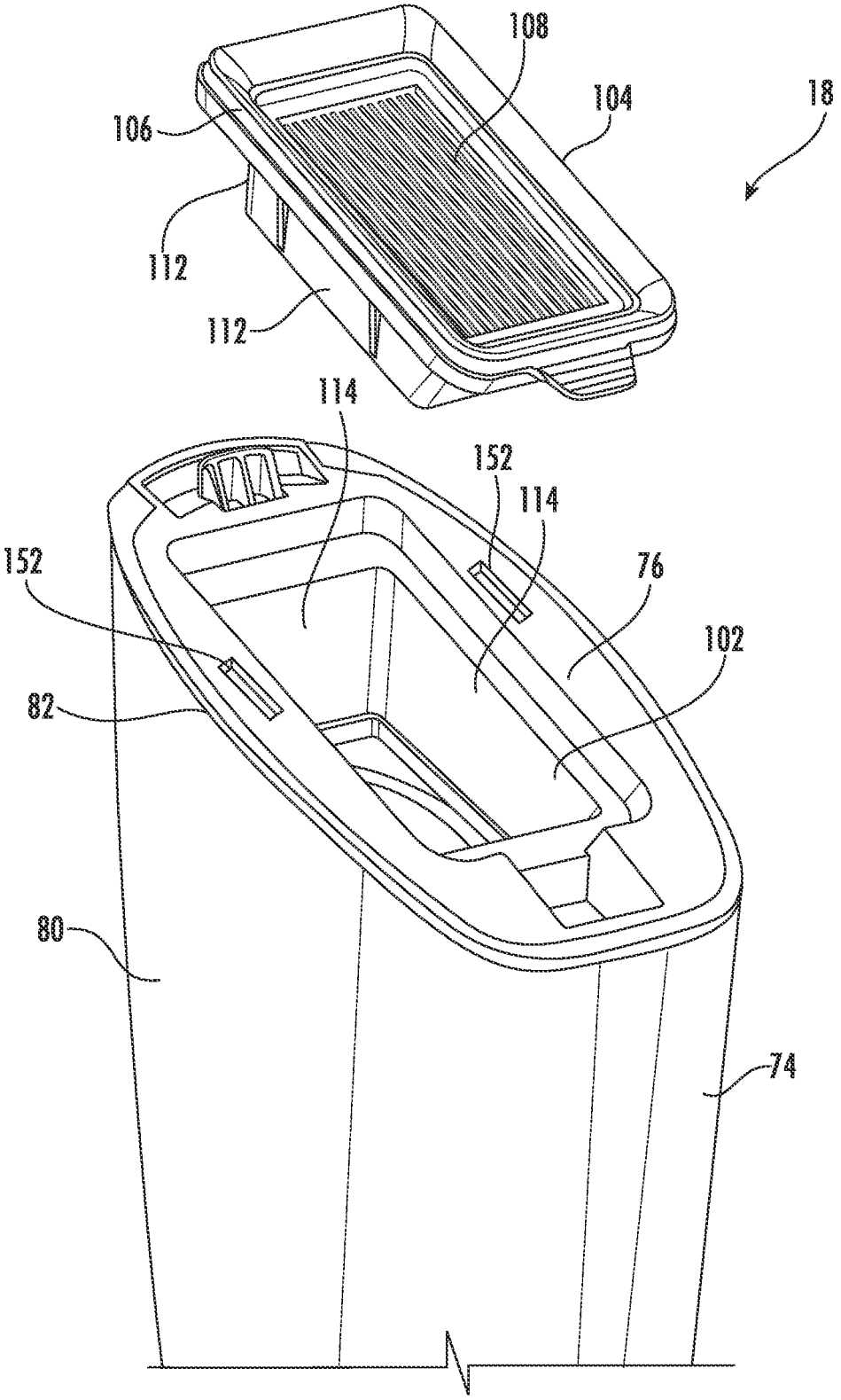
FIG. 8 is a perspective view of the recovery tank of FIG. 7 with a filter removed.

Referring to FIGS. 5 and 6, the body 14 includes a recovery tank recess 138 that receives the recovery tank 18 when the recovery tank 18 is coupled to the body 14. The tank recess 138 includes an inlet 140 in a lower portion 141 of the tank recess 138 and an outlet 142 in an upper portion 143 of the tank recess 138. The inlet 140 is in fluid communication with the suction inlet 30 and generally mates with the recovery tank inlet aperture 84 delivering cleaning fluid and/or debris drawn through the suction inlet to the recovery tank 18. The outlet 142 is generally aligned with and is adjacent the filter 104 such that air exiting the recovery tank 18 passes through the outlet 142 toward the vacuum source 20 after passing through the filter 104. The recovery tank 18 includes a latch 144 and the recovery tank recess 138 includes a latch recess 146 in the upper portion 143 of the tank recess 138 that receives the latch 144 to removably couple the recovery tank 18 to the body 14. The recovery tank recess 138 creates a portion 148 of the body 14 that is relatively narrow and flexible relative to the other portions of the body 14. When the narrow portion 148 flexes in a rearward direction, the front height 153 of the tank recess 138 may increase. In order to prevent unwanted release of the latch 144 from the recess 146 when the tank recess front height 153 increases, the body 14 includes projections 150 that are received in corresponding recesses 152 of the cover 76 of the recovery tank 18. The interaction of the projections 150 in the recesses 152 holds the cover 76 in its position relative to the upper portion 143 of the tank recess 138 and the latch recess 146. In operational circumstances when the narrow portion 148 flexes in a rearward direction and the tank recess front height 153 increases, the recovery tank body 74 may remain seated in the lower portion 141 of the recovery tank recess 138 due to weight of cleaning solution in the recovery tank. When the cover 76 remains connected to the upper portion 143 of the recover tank recess 138 and the recovery tank body 74 remains connected to the lower portion 141 of the recover tank recess 138, the cover 76 moves relative to the tank body 74 toward the open upper end 82 of the recovery tank. The lid seal 79 is configured to providing sealing engagement for the distance 81 of the travel of the cover 76 along the sidewall, selected to accommodate the amount of flexibility in the narrow portion 148.

In an alternative embodiment, not shown, the recovery tank cover may be fixed to the recovery tank body and the recovery tank body retained in the lower portion of the recovery tank recess. In such an embodiment, engagement of the projections 150 received in the corresponding recesses 152 of the cover inhibit relative movement between the components stiffening the body along the narrow portion providing additional support.

In the illustrated embodiment, the projections 150 are located in the recovery tank recess 138 and the corresponding recesses 152 are located in the cover 76 of the recovery tank 18. In other embodiments, the projections 150 and recesses 152 may be in other suitable locations. For example, the recovery tank 18 may include the projections 150 and the body 14 may include the recesses 152. Also, in the illustrated embodiment, the floor cleaner 10 includes two projections 150 and two recesses 152, in other embodiments, the floor cleaner 10 may include one or more than two of each of the projections 150 and recesses 152.

In one embodiment, the recovery tank is a collection bin having a cover, for example for a dry vacuum or other wet or dry suction cleaner, wherein the collection bin includes at least one projection and/or recess and the body includes the corresponding projections or recesses. In this embodiment, the interaction of the one or more projection in the corresponding recess holds the collection bin in its position relative to the body.

Steerable Extractor

Referring to FIGS. 2-4 and 12-14, the body 14 is pivotable relative to the base 12 about the first axis 160 between the upright storage position (FIG. 2) and inclined operating position. The body 14 is pivoted about the first axis 160 by the user using the handle 34. The base 12 further includes a brushroll 162 (FIG. 4) that is rotatable relative to the base 12 about a brushroll axis 164. The first axis 160 is offset from the brushroll axis 164 is a direction toward the back side 56 of the floor cleaner 10. The first axis 160 is parallel to the brushroll axis 164 in the illustrated embodiment. Also, in the illustrated embodiment, the first axis 160 extends through the wheels 28 of the base 12. In some embodiments, the first axis 160 is coaxial with the axis about which the wheels 28 rotate.

The body 14 is also pivotable relative to the base 12 about a second axis 166 to steer the base 12 as the base 12 moves over the surface 22. The body 14 is pivoted about the second axis 166 by the user using the handle 34. The floor cleaner 10 further includes a left side 168 normal to the front side 54 and the back side 56 and a right side 170 opposite the left side 168 and normal to the front side 54 and the back side 56. The user pivots the body 14 about the second axis 166 to move the body 14 relative to the base 12 in a first direction toward the right side 170 and in a second direction toward the left side 168 to steer the floor cleaner 10 left or right and the user pushes the floor cleaner 10 along the surface 22.

The second axis 166 is perpendicular to the first axis 160 and the brushroll axis 164 in the illustrated embodiment. The second axis 166 extends in a direction from the back side 56 to the front side 54. Also, the illustrated second axis 166 is inclined relative to the surface 22 when the body 14 is in the upright storage position such that the second axis 166 is at an acute angle 174 relative to the surface 22 as illustrated FIG. 4. In the illustrated embodiment, the angle 174 is about 30 degrees. In other embodiments, the angle 174 is in a range from about 25 degrees to about 35 degrees. In yet other embodiments, the angle 174 is in a range from about 15 degrees to about 45 degrees.

The floor cleaner 10 includes a link 172 that connects the body 14 to the base 12. The link 172 is pivotably coupled to the base 12 forming the first axis 160 along the pivot and the link 172 coupled to the body 14 along the steering axle 72 forming the second axis 166. The link 172 functions as a steering couple by constraining the body 14 and the base 12 for co-rotation about the steering axis. The link 172 includes one or more slots 173 that engage corresponding protrusions on the body 14 functioning as stops to limit a pivoting range of movement of the body 14 about the second axis 166. In one embodiment, the slots 173 limit a range of pivoting movement of the body 14 about the second axis to an angle of about 30 degrees in both the first direction and the second direction. In other embodiments, the range of pivoting movement is in a range from about 25 degrees to about 30 degrees in both directions. In other embodiments, the range of pivoting movement is in a range from about 15 degrees to about 50 degrees in both directions. The link 172 or the base 12 further includes at least one stop for limiting pivoting range of movement of the body 14 about the first axis 160. In one embodiment, pivoting range of movement of the handle axis 46 about the first axis 160 is from a position of about 90 degrees from the surface 22 (i.e., an upright storage position) to a position about 30 degrees from the surface 22 in a direction towards the back side 56 of the floor cleaner 10.

Accordingly, steering of the base 12 can be controlled by rotating the body 14 about the steering axis by twisting the handle grip to direct the base 12 in the desired direction. As the body 14 rotates about the steering axis, co-rotation of the body 14 with the link 172 turn the base 12 in plane parallel contact with the floor. Pivoting movement of the link 172 about the axis 160 may also help to maintain the base 12 in plane parallel contact with the floor. In the illustrated embodiment, the center of gravity 58 when the supply tank 16 is full of cleaning fluid and the recovery tank 18 is empty is located rearward of the steering axis. In one embodiment, the center of gravity axis 64 is along or rearward of the steering axis.

In the illustrated embodiment the link 172 is in the form of a yoke. The yoke 172 defines an opening 176. A suction conduit 178, which provides fluid communication between the suction inlet 30 and the recovery tank 18, passes through the opening 176 of the yoke 172. In the illustrated embodiment, the yoke 172 is hollow, and may be divided into two internal chambers, such as a right chamber 177 and a left chamber 179. A conduit 180 (e.g., plastic tubing) that fluidly couples the supply tank 16 and the distribution nozzle 32 extends through the yoke 172 and into the base 12. In one embodiment, the conduit 180 extends through either the right chamber 177 or the left chamber 179, and wires 181 for powering components in the base 12 extend through the other of the right chamber 177 or the left chamber 179. The yoke 172 may include internal dividers isolating the right chamber 177 from the left chamber 179 such that the wires 181 remain separated from the conduit 180 passing though the yoke.

Hydrophobic Roller

Figure 16:
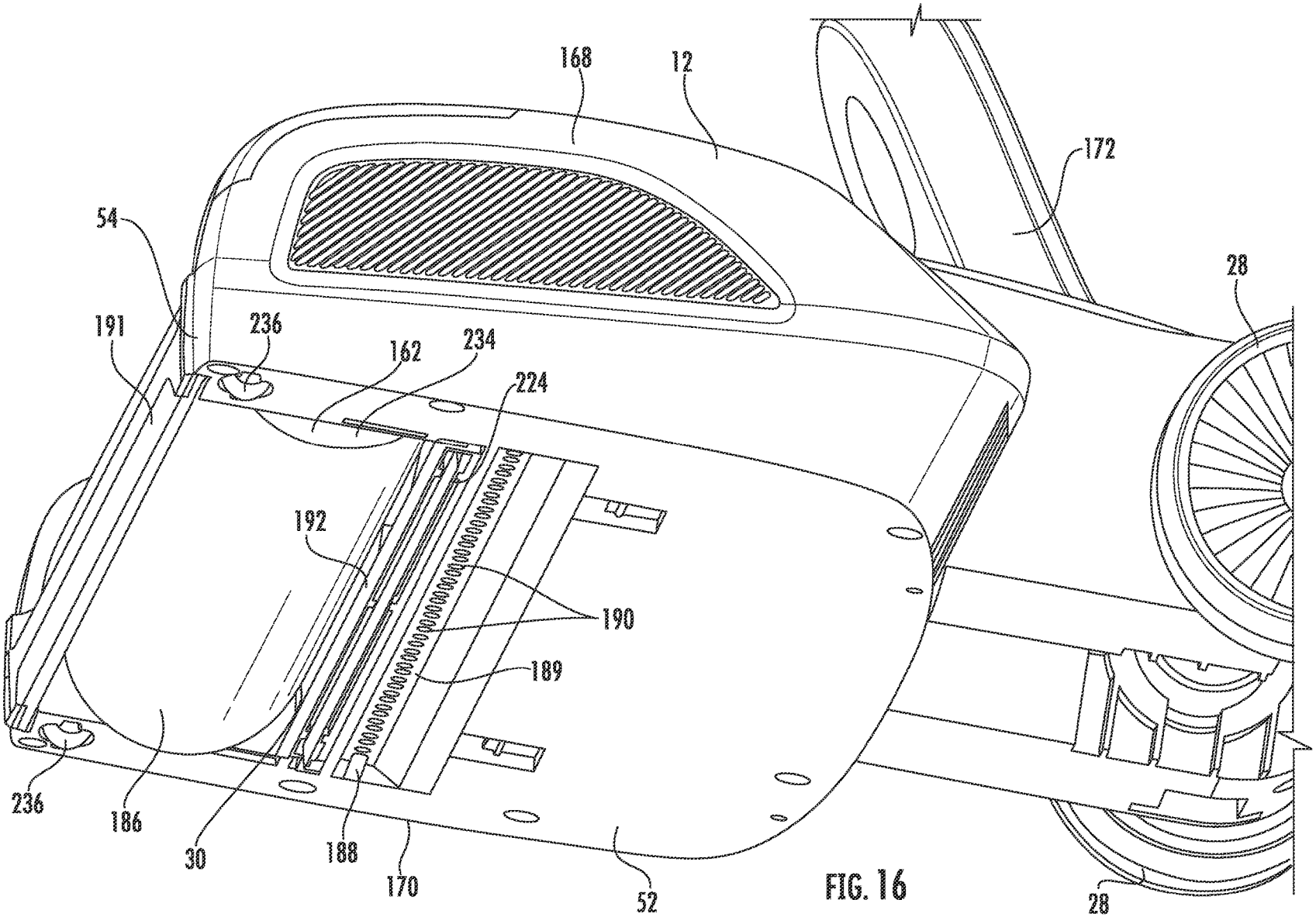
FIG. 16 is a perspective view of the underside of the base of the floor cleaner of FIG. 1
Figure 17:
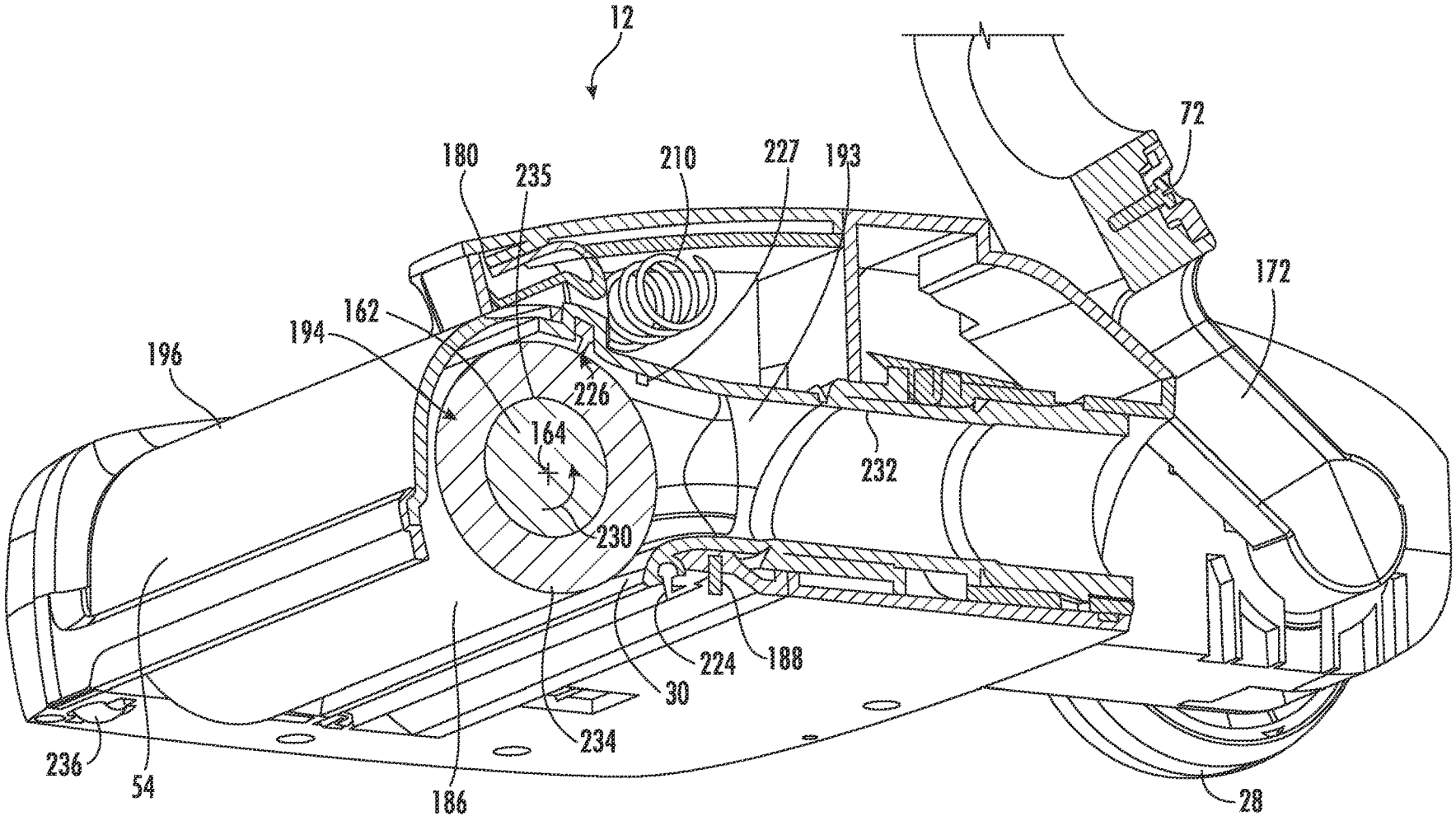
FIG. 17 is a cross-sectional view of the base of the floor cleaner of FIG. 1

As discussed above, the floor cleaner 10 includes the brushroll or agitator roll 162 adjacent the suction inlet 30 (FIGS. 16 and 17). The brushroll 162 is rotatable about the axis 164 to agitate, wipe, scrub, etc. the surface 22 that is being cleaned. The floor cleaner 10 includes a motor 184 (FIG. 12) that rotates the brushroll 162 about the axis 164. The brushroll 162 is operably connected to the motor 184 by a transmission that may include a belt, pulleys, gears, and the like.

Figure 15:
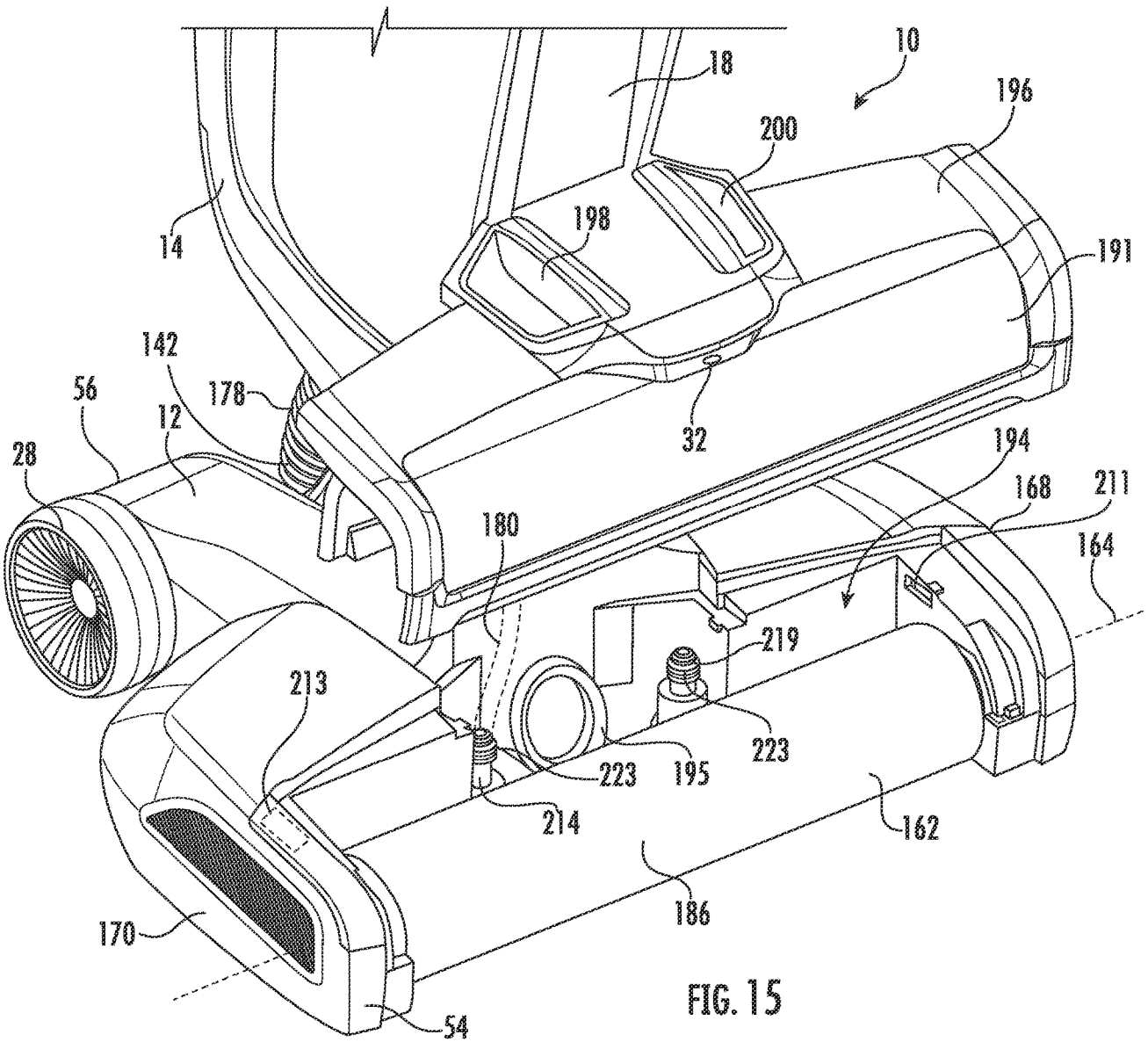
FIG. 15 is a perspective view of the portion of the floor cleaner of FIG. 1 with a brushroll cover removed

Referring to FIGS. 15-16, the brushroll 162 protrudes from the lower end 52 of the base 12 so that the brushroll 162 contacts the surface 22 being cleaned. In one embodiment, the brushroll 162 and suction inlet 30 cooperate to ingest air and debris from the lower end 52. In another embodiment, the brushroll 162 and suction inlet 30 cooperate to ingest air and debris from the front side 54 of the base 12. Also, although the illustrated floor cleaner 10 includes only a single brushroll 162, in other embodiments, the floor cleaner 10 may include additional brushrolls parallel to the brushroll 162 and formed from the same or different materials. The brushroll 162 has an outer cleaning medium 186 that contacts the surface 22. The cleaning medium 186 includes a hydrophobic textile material in one embodiment.

The hydrophobic textile material of the cleaning medium 186 may include a fine tufted fabric material. In one embodiment, the tufted textile material of the cleaning medium 186 is formed by a tufted pile of fine hydrophobic fibers, such as hydrophobic nylons, polyesters, polyolefins, or other hydrophobic fibers arranged on the brushroll 162. The fibers can be made from any hydrophobic materials such as a flouropolymer such as polytetrafluoroethylene in one embodiment. In another embodiment, the fibers are coated with a hydrophobic coating or otherwise treated to be hydrophobic.

The material for the tufted fibers of the hydrophobic textile material of the cleaning medium 186 has hydrophobicity measured by a contact angle in a range from 90° to 135° in one embodiment. In another embodiment, the hydrophobicity of the tufted material for the cleaning medium 186 is measured by a contact angle greater than 135°. In yet another embodiment, the material forming the textile material for the cleaning medium 186 has a hydrophobicity measured by a contact angle in a range from 65° to 100°.

Referring to FIGS. 16 and 17, the lower end 52 of the base 12 may include a plurality of bristles 188, which are tufted bristles in one embodiment. The bristles 188 are arranged in a row and are generally fixed relative to the base 12. The bristles 188 are received in an aperture 190 to attach the bristles 188 to the base 12. Only one group of bristles 188 is illustrated in both FIGS. 16 and 17, but it should be understood that a group of bristles 188 would be in each of the apertures 190. In one embodiment, the bristles 188 include a hydrophilic cleaning medium. In some embodiments, the base 12 includes no hydrophilic cleaning media other than, optionally, the plurality of tufted bristles 188. In yet other embodiments, the base 12 includes no hydrophilic cleaning media.

Lift-Off Cover Over Foot

Referring to FIG. 15, the base 12 includes a brushroll chamber 194 and a brushroll cover 196 that is removable to access the brushroll chamber 194 and the brushroll 162. The cover 196 is easily removable by the user, and may be removable using one hand, to access the brushroll 162 for cleaning or replacement.

The base 12 includes a first actuator 198 and a second actuator 200 that are used to remove the cover 196. The first actuator 198 slides in a first direction (represented by arrow 202, FIG. 18) to move the actuator 198 from a latched position and to an unlatched position. The second actuator 200 slides in a second direction (represented by arrow 204), directly opposed to the first direction, from a latched position and an unlatched position. That is, the first actuator 198 is pushed or pressed by the user in the direction 202 while the second actuator 200 is pushed or pressed by the user in the opposite direction 204. The spacing between the actuators 198, 200 is configured to allow the actuators 198, 200 to be operated or squeezed by a single handle of a user (e.g., user's thumb and index finger). In one embodiment, the actuators 198, 200 are undercut, wherein a surface 201 of one or both of the actuators 198, 200 with which the user operates or squeezes is recessed below an upper portion or ledge 203, the recessed surface 201 providing clearance and the upper portion or ledge 203 of each actuator 198, 200 providing a grip to the user to lift the cover 196 from the base 12 (e.g., with one hand).

Figure 20:
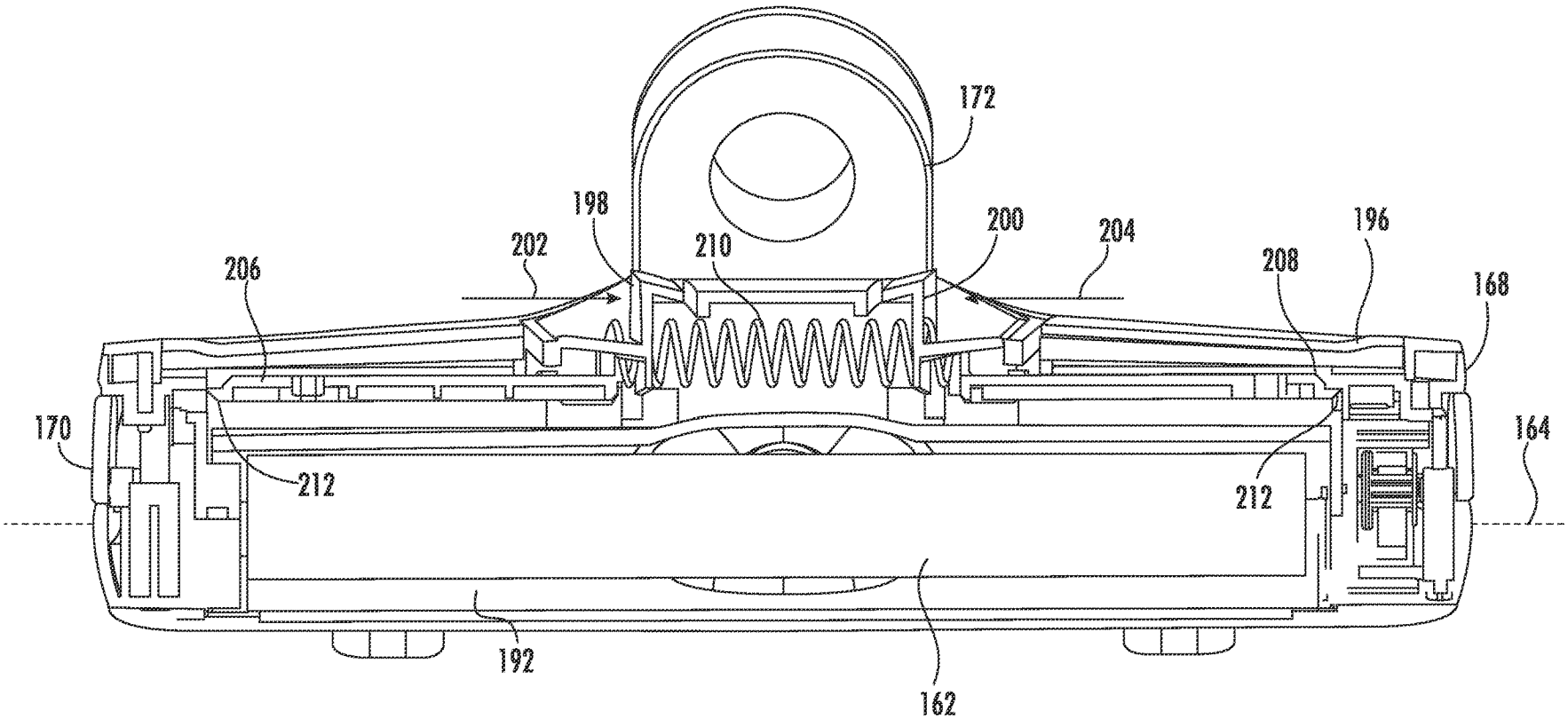
FIG. 20 is a cross-sectional view of the base of the floor cleaner of FIG. 1.
Figure 21:
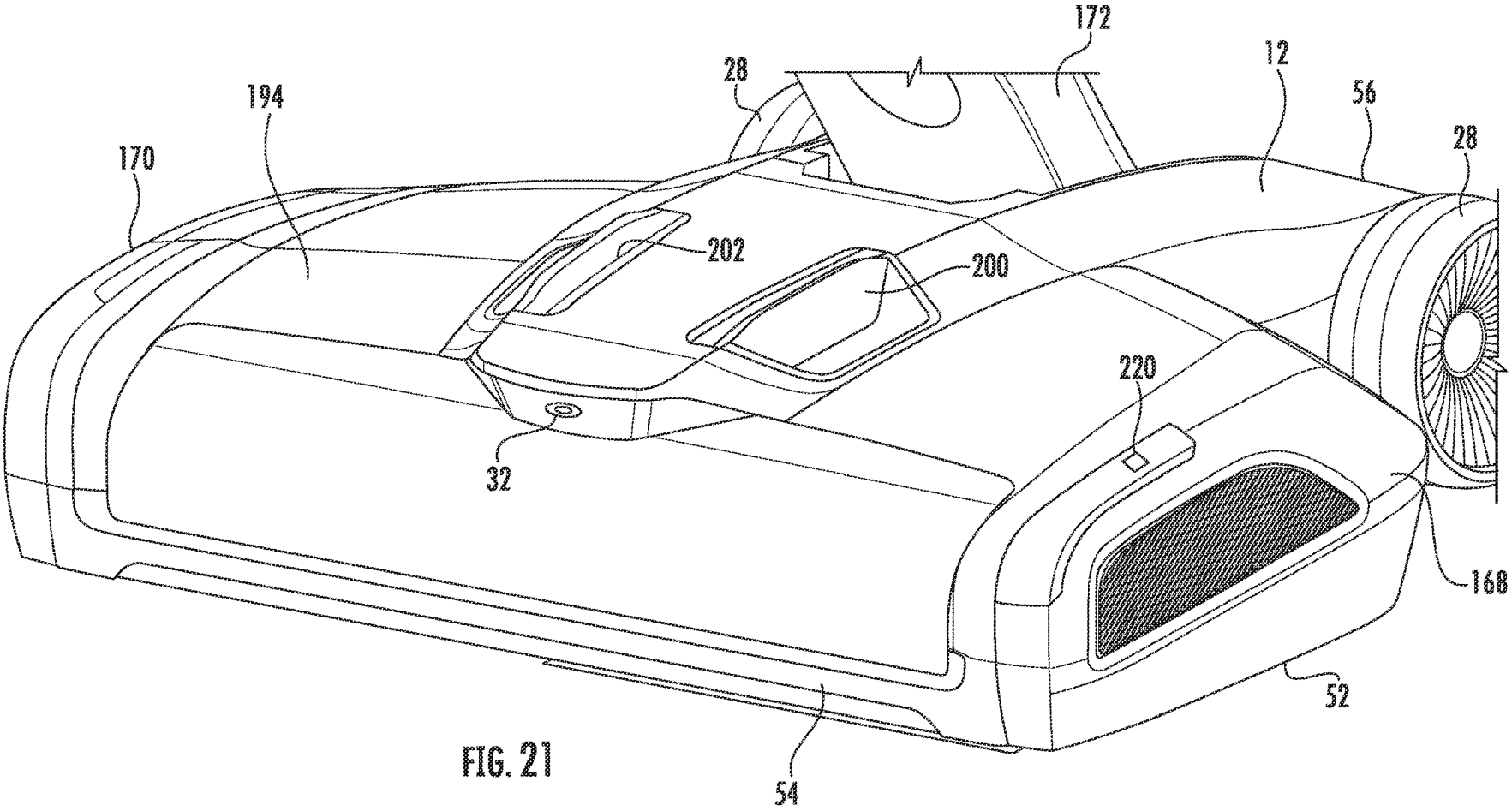
FIG. 21 is a perspective view of the base of the floor cleaner of FIG. 1 with the brushroll cover attached to the base.

Referring to FIG. 20, a first latch 206 is coupled to the first actuator 198 and a second latch 208 is coupled to the second actuator 200. When the first actuator 198 moves from the latched position to the unlatched position, the first latch 206 moves in the same direction from an engaged position with the base 12 (position shown in FIG. 20) to a disengaged position with the base 12. When the second actuator 200 moves from the latched position to the unlatched position, the second latch 208 moves in the same direction from an engaged position with the base 12 (position shown in FIG. 20). As best shown in FIG. 15, the second latch 208 engages a corresponding right retainer 211 in the base 12 in the engaged position. The first latch 206 engages a corresponding left retainer 213 in the engaged position. With the latches 206, 208 in the disengaged positions, the cover 196 can be removed from the base 12. In the illustrated embodiment, the actuators 198, 200 and the latches 206, 208 are coupled to the cover 196 so that the actuators 198, 200 and the latches 206, 208 are removed from the base 12 with the cover 196.

With continued reference to FIG. 20, a spring or biasing member 210, which is a coil spring in the illustrated embodiment, is located between the actuators 198, 200. The spring 210 may be any spring or resilient member configured to presses the actuators 198, 200 into the latched positions and the latches 206, 208 into the engaged positions. In the illustrated embodiment, the latches 206, 208 both include a cam surface 212. The cam surfaces 212 allow the cover 196 to be reattached to the base 12 without the user having to actuate or squeeze the actuators 198, 200. The cam surfaces 212 contact the base 12 to automatically move the actuators 198, 200 toward the unlatched positions to allow the cover 196 to be reattached to the base 12. The biasing member 210 then moves the actuators 198, 200 into the latched positions and the latches 206, 208 into the engaged positions.

Figure 19:
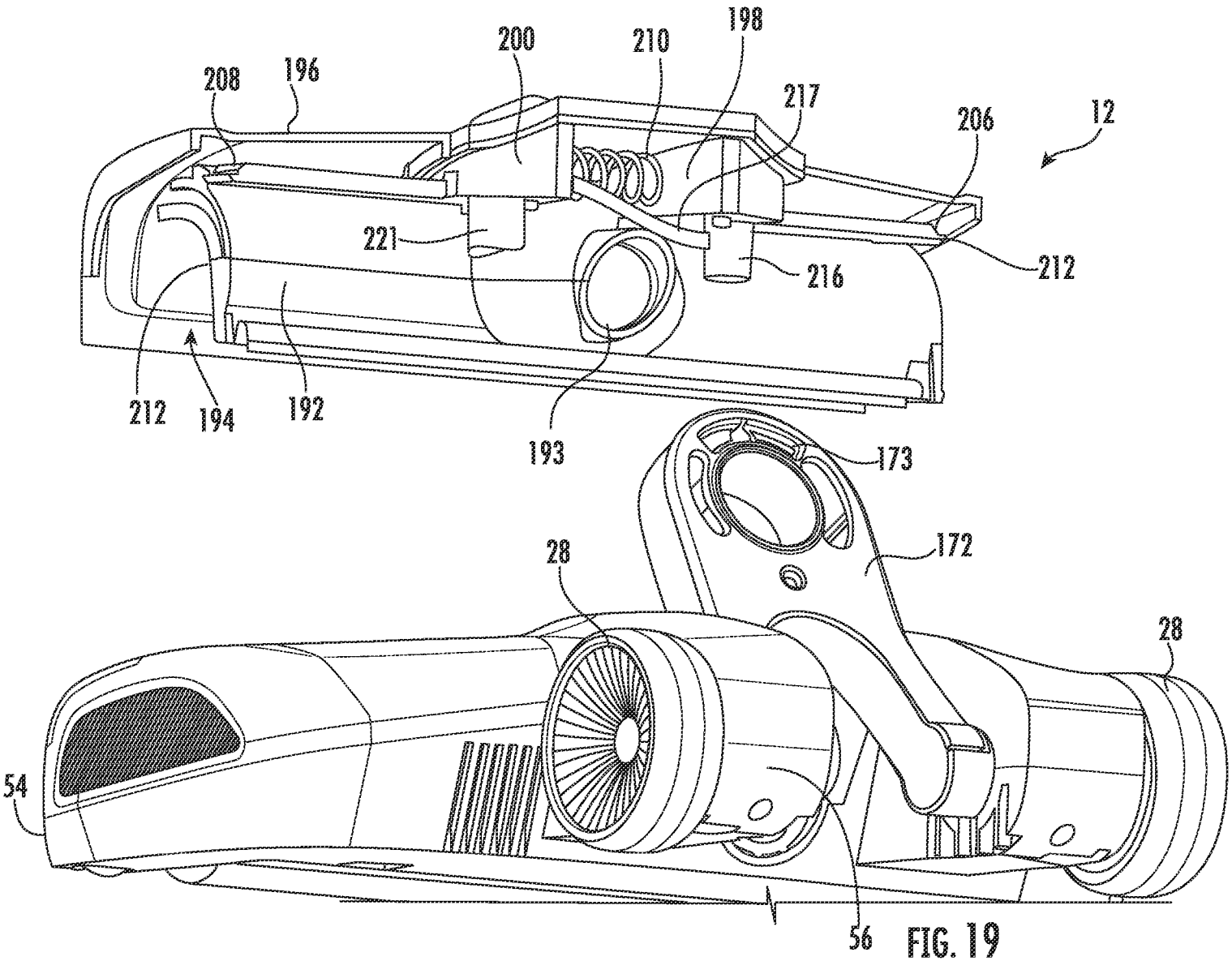
FIG. 19 is an alternative perspective view of the portion of the floor cleaner of FIG. 18 with the brushroll cover removed from the base.

Referring to FIGS. 15 and 19, the distribution nozzle 32 is attached to the brushroll cover 196 and the nozzle 32 is removable from the base 12 with the cover 196. The base 12 includes a fluid coupling 214 having a seal 223 and the cover 196 includes a fluid coupling 216 that mates with the fluid coupling 214. A connecting conduit 217 extends through the cover 196 between the fluid coupling 216 and the nozzle 32. The couplings 214, 216 allow the cover 196 to be removable from the base 12 and yet provide fluid communication between the supply tank 16 and the distribution nozzle 32 via the supply conduit 180 when the cover 196 is attached to the base 12.

Optionally, such as shown in the embodiment illustrated in FIGS. 15 and 19, the base includes a second coupling 219 engaging a corresponding recess 221 in the cover 196. The second coupling 219 is shaped similar to the first fluid coupling 214 and also includes the seal 223. When a user assembles the cover 196 to the base, force is applied to connect the fluid coupling 214, 216. The location of the first fluid coupling 214 in the illustrated embodiment is off-center relative to the cover 196 and the latch actuators 198, 200. The second coupling 219 and corresponding recess 221 is off-center in the opposite direction and configured to provide a coupling resistance similar to the coupling resistance of the first fluid coupling 214. The approximately symmetrical coupling resistance provided by the fluid coupling 214, 216 and the coupling 219 inhibit binding and provide a more uniform assembly motion. In the illustrated embodiment, the second coupling 219 does not convey any fluid and is a non-fluid coupling. In other embodiments, the second coupling 219 may convey fluid to the nozzle 32.

Lights Illuminating Water Spray

Figure 18:
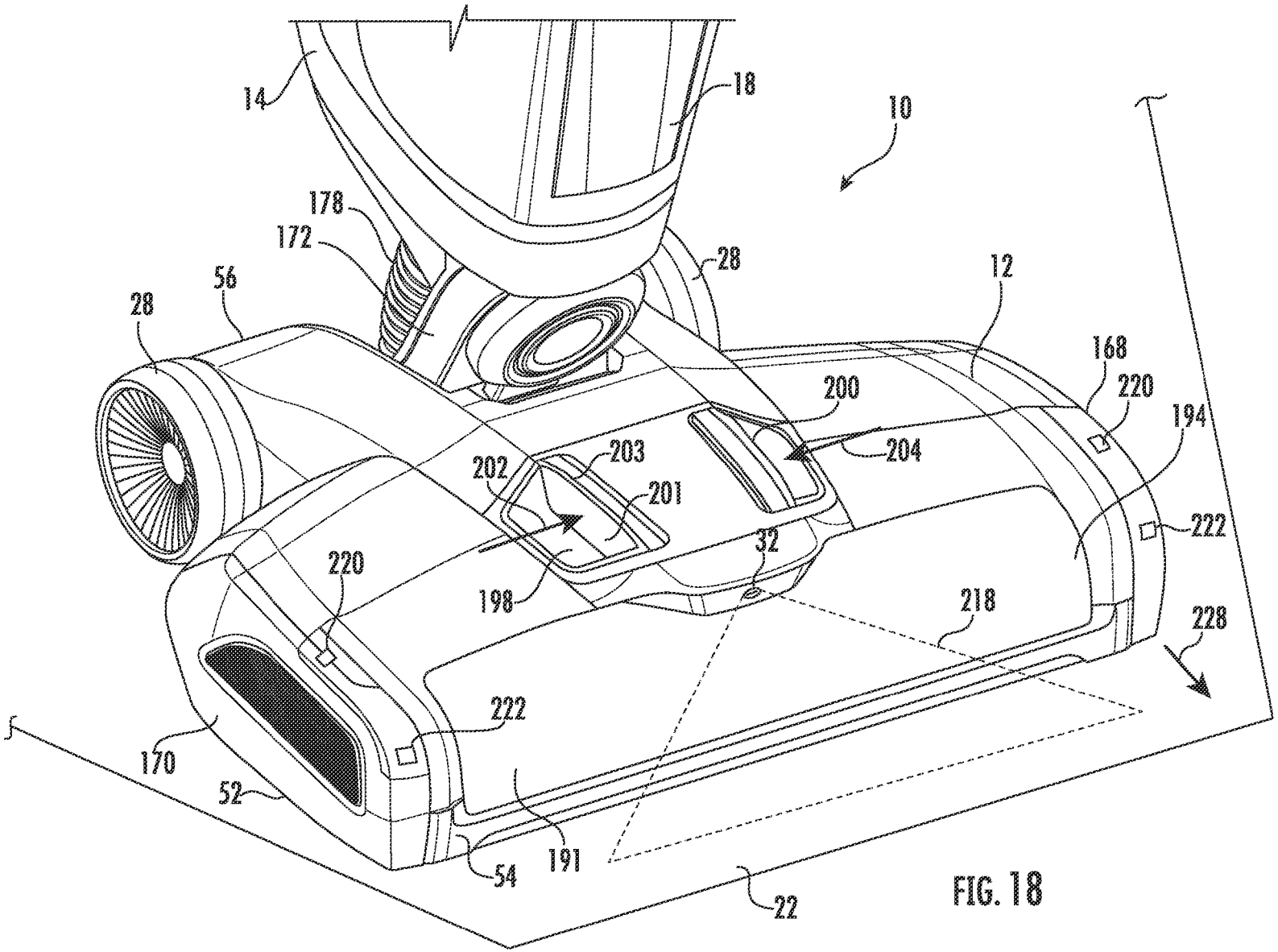
FIG. 18 is a perspective view of a portion of the floor cleaner of FIG. 1 with the brushroll cover attached to the base.

Referring to FIG. 18, in the illustrated embodiment, the distribution nozzle 32 casts a spray pattern 218 of the cleaning fluid from the supply tank 16 onto the surface 22. The spray pattern 218 is sprayed out in front of the front side 54 of the base 12. That is, the cleaning fluid is not sprayed under the brushroll cover 196 where it cannot be seen by the user. The spray pattern 218 is visible to the user because the spray pattern 218 is out in front of the base 12. In the illustrated embodiment, the cleaning fluid is sprayed or distributed from the nozzle 32 in response to the user's actuation of the actuator 38 (FIG. 1), which is a trigger in the illustrated embodiment. In one embodiment, the actuation of the fluid distribution may be controlled by motion of the cleaner or other automated modes.

Figure 13:
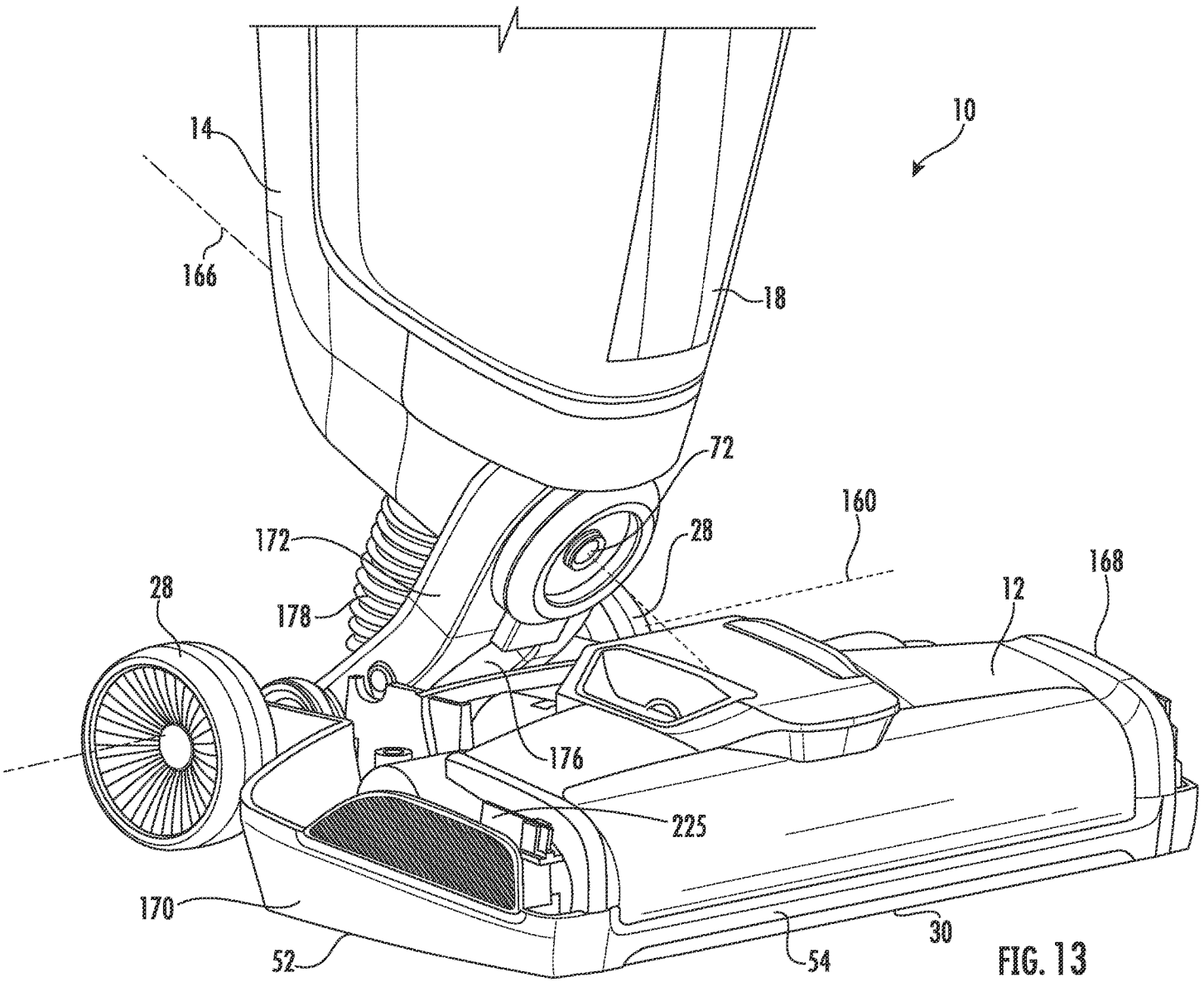
FIG. 13 is an alternative perspective view of FIG. 12.
Figure 14:
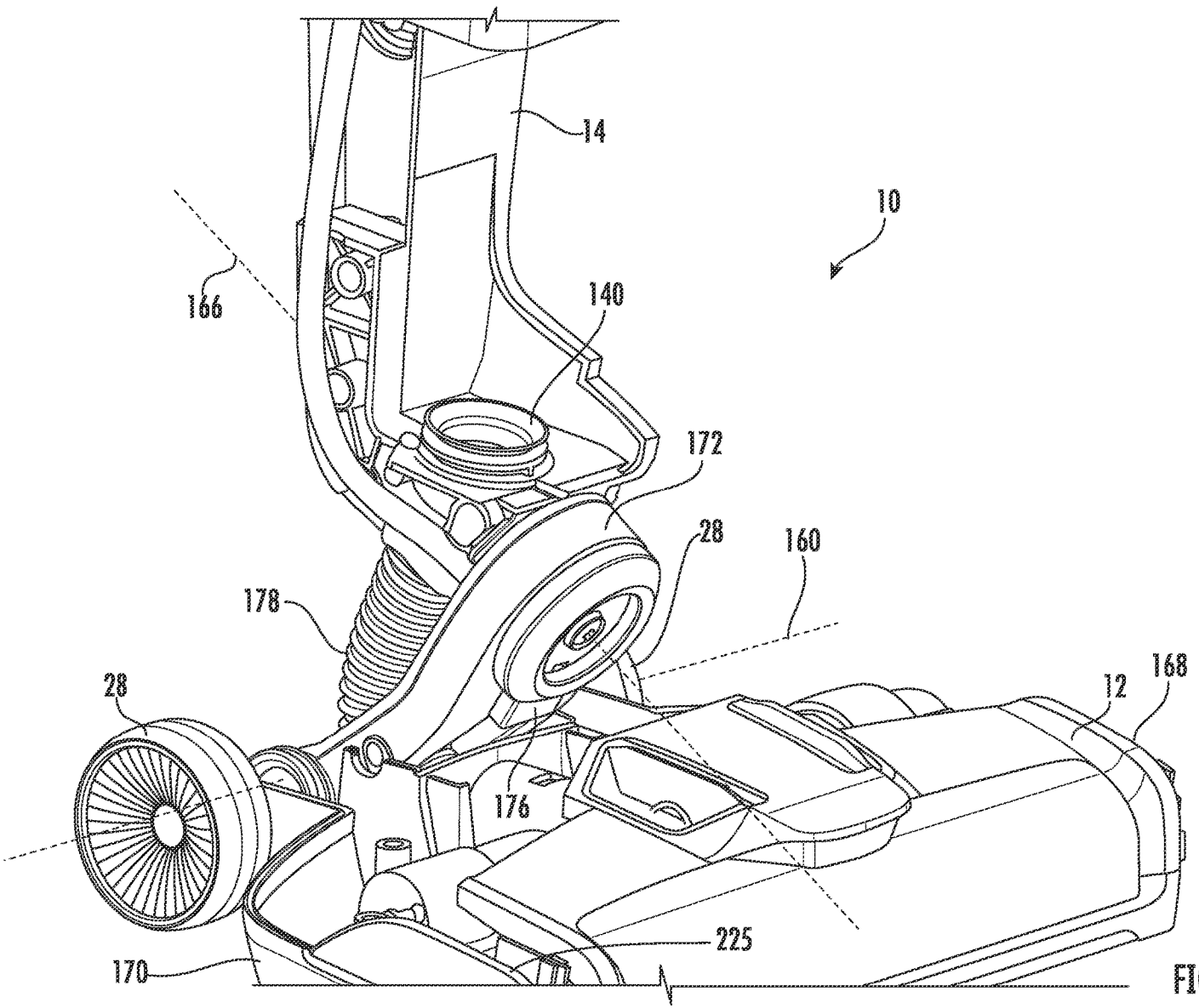
FIG. 14 is a perspective view of a portion of the floor cleaner of FIG. 1.

With continued reference to FIG. 18, the base 12 includes lights 222 electronically coupled to a printed circuit board (PCB) 225 (FIG. 13). In the illustrated embodiment of FIG. 13, the PCB X is vertically mounted in the base 12 to provide space efficiency, however the PCB 225 may be positioned in alternative orientations in other embodiments (e.g., horizontal or forward-facing). In one embodiment, the lights 222 are light emitting diodes (LEDs). The lights 222 are directed toward the front side 54 of the base 12 to illuminate the spray pattern 218 so that the spray pattern 218 is even more visible to the user. In one embodiment, the lights 222 are LEDs electronically coupled to the PCB 225 and directed toward the front side 54 of the base 12. In one embodiment, the lights 222 are water resistant and/or impact resistant. In a specific embodiment, the lights 222 are side-fire LEDs.

The illumination of the spray pattern 218 by the lights 222 provides visual confirmation to the user that cleaning fluid is being discharged from the nozzle 32. In one embodiment, the lights 222 remain on continuously during operation as headlights for illumination of the working surface. In one such embodiment, the lights are positioned to also illuminate the spray pattern 218 when the spray is actuated. As shown in FIG. 18, the base may further include indicator lights 220 visible to the user during operation.

In one embodiment, the indicator lights 220, and optionally, the lights 222, are turned on in response to actuation of the actuator 38 by the user, which causes the cleaning fluid to flow through the nozzle 32. In some embodiments, the floor cleaner 10 includes a pump that draws the cleaning fluid out of the supply tank 16 and pressurizes the cleaning fluid. The indicator lights 220, and optionally, the lights 222, may then be turned on in response to power being supplied to the pump. In other embodiments, the fluid supply conduit 180 between the supply tank 16 and the nozzle 32 includes a fluid flow sensor. In one such embodiment, when the flow sensor detects fluid flow in the conduit 180, the lights are turned on, and the indicator lights 220, and optionally, the lights 222, are off if there is no flow through the conduit 180. In one alternative, when the flow sensor detects no flow in the conduit 180 after the user actuates the actuator 38, the indicator lights 220 and/or the lights 222 may provide a signal indicating no flow in the conduit, for example if the supply tank were empty or other flow interruption. In yet other embodiments, the indicator lights 220, and optionally, the lights 222, are turned on in response to power being supplied to the vacuum source 20. The indicator lights 220, and optionally, the lights 222, may be any suitable color and the color of the indicator lights 220, and optionally, the lights 222, may change depending on the operational state of the floor cleaner 10. For example, a first color maybe displayed when power is supplied to the vacuum source 20 and there is no flow of cleaning fluid. A second color may be displayed when there is flow of cleaning fluid through the nozzle 32.

Nozzle Configuration with Roller, Wiper, and Squeegee

Referring to FIG. 17, the base 12 includes a first squeegee 224 and a second squeegee 226. The first squeegee 224 contacts the surface 22 to be cleaned. When the base 12 is moved along the surface 22 to be cleaned in a forward direction (direction of arrow 228 in FIG. 18), the first squeegee 224 pushes fluid along the surface in the forward direction, including cleaning fluid, toward the suction inlet 30. This reduces the amount of fluid that remains on the surface 22. The second squeegee 226 contacts the brushroll 162. The brushroll 162 rotates about the axis 164 in the direction of arrow 230. The second squeegee 226 wipes fluid and debris from the brushroll 162 and directs the fluid and debris toward suction conduit 232 that is in fluid communication with the vacuum source 20. The location of the second squeegee 226 in combination with the spray distribution 218 of the cleaning fluid from the supply tank forward of the front side 54 of the base 12 improves cleaning performance, dry time, and minimizes the amount of fluid and debris that travels back to the surface 22 as the brushroll rotates back down toward the surface 22. The second squeegee 226 also reduces air ingress through the gap between the brushroll cover 196 and the brushroll 162.

The first squeegee 224 extends from the lower end 52 of the base 12 between the suction inlet 30 and the back side 56 of the base 12. The squeegee 224 extend along the suction inlet 30 adjacent the inlet 30 to wipe fluid toward the suction inlet 30. The squeegee 224 also extends in a direction along the brushroll axis 164, parallel to the brushroll axis 164. The brushroll 162 extends beyond the lower end 52 of the base 12 and the suction inlet 30 is between the first squeegee 224 and a location 234 wherein the brushroll 162 extends beyond the lower end 52 of the base 12. In one embodiment, the first squeegee 224 is removably coupled to the lower end 52 of the base 12 on a brush bar 189 (FIG. 16) with the bristles 188, wherein both the first squeegee 224 and the bristles 188 are removable together from the base 12 on the brush bar 189.

The second squeegee 226 is located above the first squeegee 224 and in the brushroll chamber 194. The brushroll axis 164 is between the lower end 52 of the base 12 and the second squeegee 226. The second squeegee 226 extends along and parallel to the brushroll axis 164. The second squeegee 226 is attached to the brushroll cover 196 so that the second squeegee 226 is removable from the base 12 with the brushroll cover 196. In the illustrated embodiment, the second squeegee 226 is rearward of the brushroll axis 164 in a direction from the front side 54 to the back side 56. In the illustrated embodiment, the second squeegee 226 is above the brushroll axis 164 in a direction from the lower end 52 to the upper end 50.

Optionally, a secondary distribution nozzle 227 (FIG. 17) is positioned under the cover 196 proximate a surface of the brushroll 162 and rearward of the second squeegee 226 in the brushroll chamber 194. The secondary distribution nozzle 227 is configured to wet the brushroll 162 prior to the brushroll contacting the surface 22 to be cleaned while simultaneously cleaning the brushroll 162. The second squeegee 226 is configured to wipe excess liquid from the brushroll 162. A conduit fluidly couples the secondary distribution nozzle 227 to the supply tank 16 similar to conduit 180 of distribution nozzle 32. In one embodiment, conduit 180 supplies fluid to both the distribution nozzle 32 and the secondary distribution nozzle 227.

Referring to FIGS. 16 and 17, rollers 236 configured to rotate around a roller axis extend from the lower end 52 of the base 12 to support the base 12 and the floor cleaner 10 on the surface 22. The rollers 236 are adjacent the front side 54 of the base 12 between the front side 54 of the base and the location 234 where the brushroll 162 extends beyond the lower end 52 of the base 12. In the illustrated embodiment, the rollers 236 are forward of the brushroll axis 164. In one embodiment, the rollers 236 are arcuate along the roller axis, which is parallel to the first axis 160.

Figure 17A:
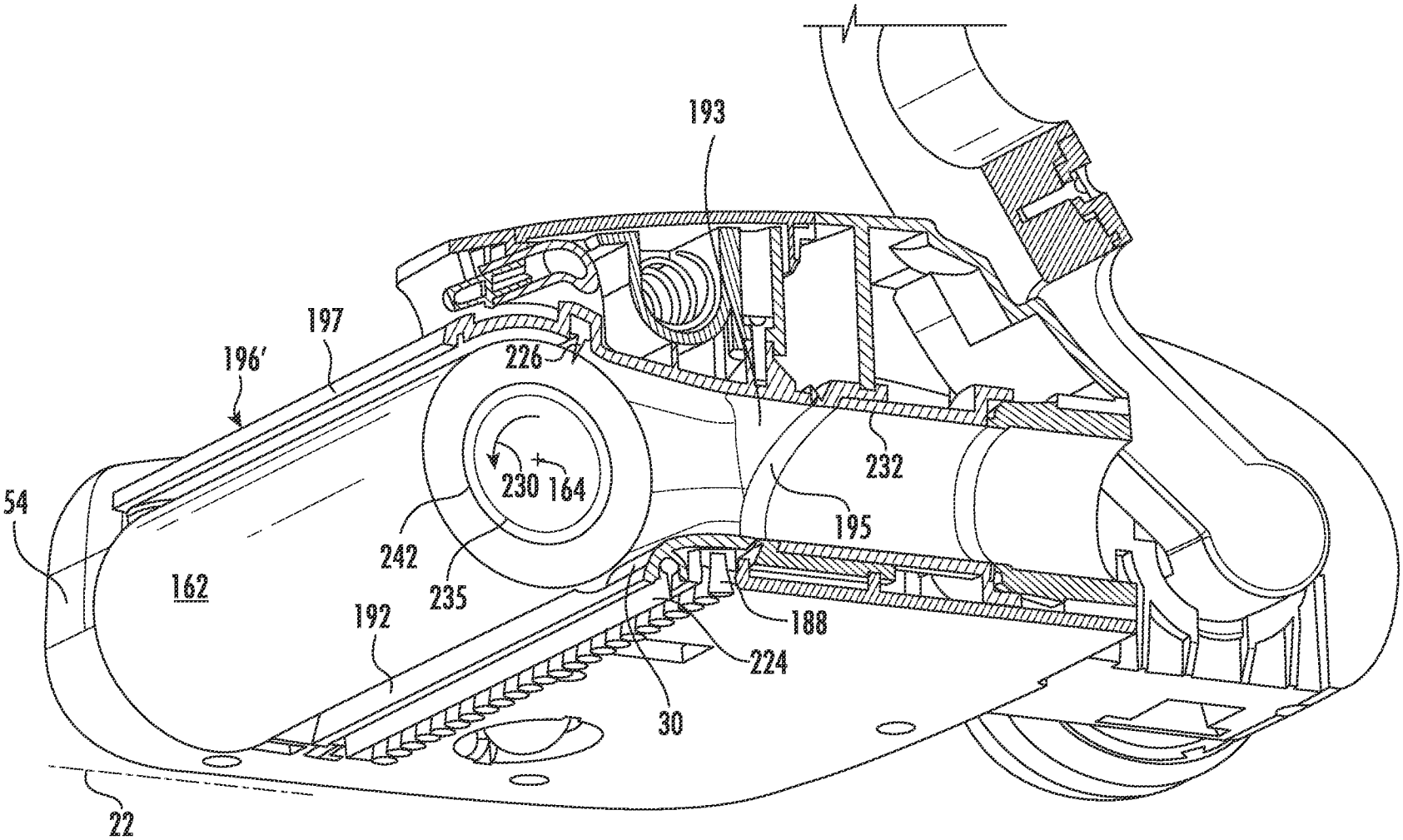
FIG. 17A is a cross-sectional view of a base of a floor cleaner according to another embodiment.

In one embodiment (FIG. 17A), the brushroll cover 196' includes a front edge 197 that is raised from the surface to be cleaned 22 forming a front opening that exposes the brushroll 162, the brushroll extending through the front opening forward of the front side 54 of the base. The exposed portion of the brushroll 162 extending beneath the front edge 197 of the brushroll cover 196' is configured for contacting and cleaning low, vertically-oriented surfaces (e.g., baseboards) forward of the front side 54. The brushroll cover 196' includes the front edge 197 positioned above the brushroll axis 164 and rearward of the front side 54. In this embodiment, the second squeegee 226 is positioned relative to the front edge 197 to inhibit discharge of debris forwardly from beneath the brushroll cover 196'.

Figure 22:
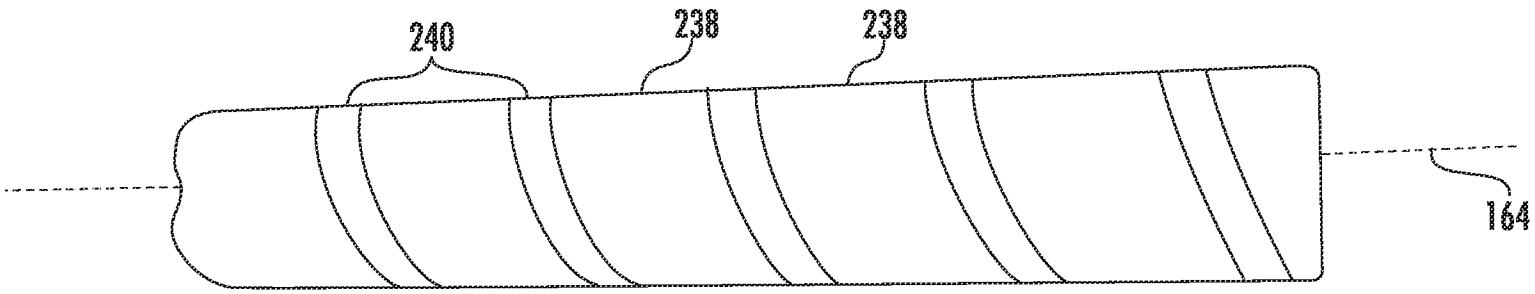
FIG. 22 illustrates an embodiment of a brushroll for use in floor cleaner of FIG. 1.

FIG. 22 illustrates one possible embodiment of the brushroll 162. Optionally, the brushroll 162 may include the hydrophobic properties and features discussed above. The brushroll 162 includes a first set of fibers 238 and a second set of fibers 240. The fibers 238, 240 are tufted on a backing, such as a textile backing or mesh backing, that is wrapped around and attached to the brushroll spindle 235 (FIG. 17). In the illustrated embodiment, the fibers 238 have a different color than the fibers 240. The fibers of the first set 238 have a diameter that is smaller than the diameter of the fibers of the second set 240. In one embodiment, the fiber diameter of the second set of fibers is at least 25% greater than the fiber diameter of the first set of fibers. In another embodiment, the fiber diameter is between 30% and 60% greater than the fiber diameter of the first set of fibers. In one embodiment, the fiber diameter of the second set of fibers is 50% greater than the fiber diameter of the first set of fibers. The fibers of the first set 238 have a diameter in a range from about 0.03 millimeters to about 0.08 millimeters. In one embodiment, the first set of fibers have a diameter of about 0.05 millimeters.

In the illustrated embodiment, the first set of fibers extend across a substantial portion of the brushroll and the second set of fibers 240 wraps around the brushroll axis 164 in a helical pattern as shown in FIG. 22. Stated another way, the first set of fibers extend between the helical wraps of the second set of fibers around the brushroll. In one embodiment, the second set of fibers 240 wraps around the axis 164 about 5 to 6 times in the helical pattern. The fibers of the second set of fibers 240 have a diameter of at least 0.06 millimeters. In one embodiment, the second set of fibers have a diameter of about 0.10 millimeters The first set of fibers 238 with the smaller diameter are more flexible and provide a wiping action on the surface 22. The second set of fibers 240 with the larger diameter are relatively stiff for agitation of the surface and dampen vibration.

In the illustrated embodiment fibers of the first set of fibers 238 and the fibers of the second set of fibers 240 have an equal length. The length of the fibers is in a range from about 5 millimeters to about 15 millimeters in one embodiment. In the illustrated embodiment, the length of the fibers is about 10 millimeters.

In one embodiment, the brushroll 162 includes a sleeve 242 between the spindle 235 and the tufted fiber backing, where the backing is attached to the sleeve 242 and the sleeve 242 is provided over the spindle. Optionally, a second sleeve may be provided, wherein a third set of fibers being tufted on a second backing is attached to the second sleeve, and wherein the first sleeve is removable from the spindle and replaceable with the second sleeve.

Various features and advantages of the invention are set forth in the following claims.

What is claimed is:

1. A floor cleaner comprising:

a vacuum source;

a supply tank configured to store a cleaning fluid;

a base movable over a surface to be cleaned, the base including:

a suction inlet in fluid communication with the vacuum source, a brushroll chamber, a brushroll in the brushroll chamber, the brushroll rotatable about a brushroll axis, and a brushroll cover releasably attached to the base, the brushroll cover removable to access the brushroll chamber and the brushroll, the brushroll cover having a squeegee that contacts the brushroll;

wherein the brushroll axis is between a lower end of the base and the squeegee.

2. The floor cleaner of claim 1, wherein the base includes an upper side opposite the surface to be cleaned, wherein the brushroll cover is removable from the base in the direction of the upper side.

3. The floor cleaner of claim 1, wherein the squeegee extends in a direction along the brushroll axis.

4. The floor cleaner of claim 1, wherein the base includes a front side and a back side opposite the front side, wherein the brushroll axis is between the front side of the base and the squeegee.

5. The floor cleaner of claim 1, further comprising a handle pivotally coupled to the base, the handle pivotable between an upright storage position and an inclined operating position.

6. The floor cleaner of claim 1, the brushroll chamber including a rear wall, wherein the brushroll chamber rear wall is attached to and removable with the brushroll cover.

7. The floor cleaner of claim 1, wherein the base includes a lower end configured to be adjacent the surface to be cleaned, and wherein the suction inlet is adjacent the lower end of the base in fluid communication with the vacuum source.

8. The floor cleaner of claim 7, wherein the base includes a front side and a back side opposite the front side, wherein the brushroll extends beyond the lower end of the base, and wherein the suction inlet is between the squeegee and a location where the brushroll extends beyond the lower end of the base.

9. The floor cleaner of claim 7, wherein the base includes a front side and a back side opposite the front side, wherein the squeegee is a second squeegee, and wherein the floor cleaner includes a first squeegee that extends from the lower end between the suction inlet and the back side of the base, the first squeegee configured to contact the surface to be cleaned.

10. The floor cleaner of claim 9, wherein the first squeegee extends along the suction inlet.

11. The floor cleaner of claim 1, wherein the brushroll cover includes a front edge that is raised from the surface to be cleaned forming a front opening that exposes the brushroll.

12. The floor cleaner of claim 11, wherein the brushroll is positioned that a portion of the brushroll extends forward of the front edge.

13. The floor cleaner of claim 1, wherein the brushroll cover includes a first actuator movable in a first direction from a latched position and to an unlatched position;

a second actuator movable in a second direction, opposite the first direction, from a latched position and an unlatched position, wherein the brushroll cover is secured to the base when the first and second actuators are in the latched positions and the brushroll cover is removable from the base when the first and second actuators are in the unlatched positions.

14. The floor cleaner of claim 13, wherein the first actuator and the second actuator slide between the latched and the unlatched positions.

15. The floor cleaner of claim 14, wherein the floor cleaner includes a left side and a right side, opposite the left side, wherein the first actuator slides from the left side toward the right side as the first actuator moves from the latched position toward the unlatched position, and wherein the second actuator slides from the right side toward the left side as the second actuator moves from the latched position toward the unlatched position.

16. The floor cleaner of claim 13, wherein the base includes a first latch and a second latch, wherein movement of the first actuator from the latched position to the unlatched position moves the first latch from an engaged position with the base to a disengaged position with the base, and wherein movement of the second actuator from the latched position to the unlatched position moves the second latch from an engaged position with the base to a disengaged position with the base.

17. The floor cleaner of claim 13, wherein the first actuator and the second actuator are removable from the base with the brushroll cover.

18. The floor cleaner of claim 13, wherein the first actuator and the second actuator are pressed toward the latched positions by a spring.

19. The floor cleaner of claim 13, wherein the floor cleaner includes an upper side opposite the surface to be cleaned, wherein the brushroll cover is removable from the base in the direction of the upper side.

20. The floor cleaner of claim 13, wherein the first direction and the second direction are directly opposed.

21. The floor cleaner of claim 13, wherein the first actuator and the second actuator are configured to be operated by a single hand of a user, wherein the first actuator is configured to be operated by a user's thumb of the single hand and the second actuator is configured to be operated by one of a user's fingers of the single hand.

22. The floor cleaner of claim 13, wherein the base includes a lower end configured to be adjacent the surface to be cleaned, and wherein the suction inlet is adjacent the lower end of the base in fluid communication with the vacuum source.

23. The floor cleaner of claim 22, wherein the base includes a front side and a back side opposite the front side, wherein the brushroll extends beyond the lower end of the base, and wherein the suction inlet is between the squeegee and a location where the brushroll extends beyond the lower end of the base.

24. The floor cleaner of claim 22, wherein the base includes a front side and a back side opposite the front side, wherein the squeegee is a second squeegee, and wherein the floor cleaner includes a first squeegee that extends from the lower end between the suction inlet and the back side of the base, the first squeegee configured to contact the surface to be cleaned.

25. The floor cleaner of claim 1, further comprising a distribution nozzle in fluid communication with the supply tank.

26. The floor cleaner of claim 25, wherein the distribution nozzle is configured to dispense the cleaning fluid onto a surface to be cleaned.

27. The floor cleaner of claim 25, wherein the distribution nozzle is disposed on the brushroll cover.

28. The floor cleaner of claim 27, wherein the base includes a base fluid coupling and the brushroll cover includes a corresponding cover fluid coupling in communication with the distribution nozzle, the base fluid coupling and the cover fluid coupling configured to engage upon installation of the cover on the base and disengage upon removal of the cover from the base.

29. The floor cleaner of claim 27, wherein the floor cleaner includes an upper side opposite the surface to be cleaned, wherein the brushroll cover is removable from the base in the direction of the upper side and wherein the base fluid coupling and the cover fluid coupling are configured to disengage in the direction of the upper side.

30. The floor cleaner of claim 27, wherein the base fluid coupling is off-center.

* * * * *